US006002912A

United States Patent [19]

Takeda

[11] Patent Number: 6,002,912

[45] Date of Patent: Dec. 14, 1999

[54] IMAGE FORMING APPARATUS WITH IMPROVED TRANSPORT

[75] Inventor: Akio Takeda, Numazu, Japan

[73] Assignee: Canon Kabushiki Kaisha, Tokyo, Japan

[21] Appl. No.: 08/975,068

[22] Filed: Nov. 20, 1997

[30] Foreign Application Priority Data

Nov. 28, 1996 [JP] Japan ..... 8-317885

[51] Int. Cl.[6] ..... G03G 15/00

[52] U.S. Cl. ..... 399/405; 399/68

[58] Field of Search ..... 399/67–68, 45, 399/401, 403, 405, 407, 406, 397; 271/65, 202, 203, 270, 403

[56] References Cited

U.S. PATENT DOCUMENTS 5,019,871 5/1991 Takeda et al. .
5,132,737 7/1992 Takeda et al. .
5,138,392 8/1992 Kinoshita et al. ..... 399/45
5,239,348 8/1993 Fukuchi et al. ..... 399/45
5,448,348 9/1995 Azeta ..... 271/65 X
5,689,760 11/1997 Suzuki et al. ..... 399/45

*Primary Examiner*—Arthur T. Grimley
*Assistant Examiner*—Quana Grainger
*Attorney, Agent, or Firm*—Fitzpatrick, Cella, Harper & Scinto

[57] ABSTRACT

An image forming apparatus has a fixing unit for fixing a toner image while transporting a sheet at a first transporting speed or a second transporting speed which is slower than the first transporting speed; an ejecting device for ejecting from the apparatus the sheet on which fixing has been performed by the fixing unit; and a holder for holding the sheet between the fixing unit and the ejecting device so that sheets subjected to fixing at the second transporting speed can reach the ejecting device after passing the fixing device. Thus an image processing apparatus which can ejects sheets at a speed which does not interfere with sheet loading, regardless of the transporting speed of the sheets when passing through the fixing unit, can be provided.

33 Claims, 21 Drawing Sheets

IMAGE FORMING APPARATUS WITH IMPROVED TRANSPORT

BACKGROUND OF THE INVENTION

1. Field of the Invention

The present invention relates to an image forming apparatus for photocopiers, printers, facsimiles, and so forth.

2. Description of the Related Art

A known color printer will now be described with reference to FIG. 18.

Recording paper 2 loaded on a cassette 1 is transported out by means of a pick-up roller 1*a,* with only the uppermost recording paper sheet being transported downstream by a feeding roller 1*c* and reverse-rotating separating roller 1*b* rotating in the direction opposite to the feeding direction. Next, the recording paper 2 is transported following the transporting path by means of a plurality of transporting roller pairs 1*d,* and the leading end thereof is retained by the nipping portion of a stationary resist roller pair 3 so that the recording paper 2 is bowed, thereby correcting any slant.

On the other hand, 6*a,* 6*b,* 6*c,* and 6*d* denote image forming means which form yellow, magenta, cyan, and black toner images on recording paper, respectively. Making description regarding 6*a* representatively, 6*a*1 denotes a photosensitive drum which rotates in the clockwise direction, 6*a*2 denotes a laser scanner which irradiates a laser beam upon the photosensitive drum 6*a*1 and forms an electrostatic latent image, and 6*a*3 is a developing unit which develops the electrostatic latent image formed on the surface of the photosensitive drum 6*a*1 using yellow toner.

The resist roller 3 starts rotating at a timing synchronous with the toner image formed on the photosensitive drum 6*a*1 and feeds the recording paper 2. The recording paper 2 which has been sent out is pressed against a charged transfer belt 5 by means of an adhesion roller 4, and the recording paper is subjected to electrostatic adhesion to the transfer belt 5.

The yellow toner image formed on the photosensitive drum 6*a*1 is transferred to the recording paper 2 which is transferred by the transfer belt 5, by transfer means 7*a.*

In the same way, magenta, cyan, and black toner images are transferred onto the recording paper 2 by means of the image forming means 6*b,* 6*c,* 6*d,* and transfer means 7*b,* 7*c,* and 7*d.*

8 denotes a heating fixing unit serving as fixing means, having a halogen heater built in a roller, which fixes onto the recording paper 2 the toner image transferred onto the recording paper 2 transported by the transfer belt 5.

The recording paper 2 which has passed through the fixing unit 8 is transported by an inner paper ejecting roller 9, and is ejected into a paper eject tray 11 by ejecting means comprising an outer paper ejecting roller 10.

Also, in the event that an image is to be formed on the opposite side of the recording paper 2 to which an image has already been formed on the first side thereof, a flapper 13 is rotated in a counter-clockwise direction, and the leading end of the recording paper 2 which has passed the inner paper ejecting roller 9 is guided to a reversal path 14 by means of the flapper 13. The recording paper 2 is transported to a switch-back path 31 by means of a first transporting roller 15 and a second transporting roller 16.

Once the trailing end of the recording paper 2 passes a reverse transport prevention guide 32 formed of a calcined sheet, the second transporting roller 16 is reversed so as to cause the recording paper 2 to switch-back. The leading edge of the recording paper 2 transported in the reverse direction is guided to a both-side transporting path 33 by means of the reverse transport prevention guide 32, and is transported by a both-side transporting roller 30 until reaching a transporting roller 1*d.*

The transporting roller 1*d* transports the recording paper 2 to the resist roller again, and an image is formed on the second side thereof by the same procedures as the process described above, thus completing image formation on both sides of the recording paper 2.

In the above image forming process, OHP (overhead projector) sheets or resin sheets, heavy paper (such as 157 $g/m^2$ paper or 209 $g/m^2$ paper), etc. is so thick that the paper absorbs the heat of the fixing unit, resulting in an imbalance with the thermal generating capabilities of the halogen heater, and consequently fixing is not performed correctly.

Particularly, with a color image forming apparatus such as illustrated in FIG. 18, a plurality of colors of toner are overlaid and transferred, so there is the necessity to increase the amount of heat more than normal, in order to cause the toner to completely melt and to develop transparency, since a greater amount of toner is deposited on the recording paper 2.

Raising the thermal capabilities of the halogen heater will deal with this problem, but creates other problems such as increased electrical current value, increased cost of the halogen heater, etc., so this problem is generally dealt with by lowering the transfer speed (the transporting speed of the recording paper) to increase the amount of time that the recording paper is passing through the fixing unit.

However, regarding the known example such as described above, the speed of the recording paper being ejected to the paper eject tray by the outer paper ejecting roller 10 also is decreased, causing problems such as those described below.

First, the base material for the OHP sheets is PET film, which softens due to the head of the fixing unit. As shown in FIG. 19, in the event that the softened OHP sheets are ejected with the outer paper ejecting roller 10, the leading edge thereof sags down to the paper eject tray 11 due to the weight thereof, and there has been the possibility of the OHP sheets curling up on the paper eject tray 11 as shown in FIG. 20.

In order to prevent this, ejecting needs to be completed before sagging under the sheet's own weight occurs. However, the output speed needs to be decreased for the aforementioned reason, and this has been a great problem regarding OHP sheet output.

FIG. 21 illustrates an arrangement in comparison with the known example, this arrangement being provided with a sorter 40 to the paper eject unit of a color printer 100 provided with sorting means for performing sorting of a plurality of copies of recording paper.

The recording paper 2 which has passed the outer paper ejecting roller 10 is ejected onto one of the sorter trays 42 of which a plurality are provided on the sorter 40, this ejecting being performed by means of a sorter roller 41. The sorter 40 has a plurality of sorter trays 42 arranged vertically. This sorting is performed by means of the plurality of sorter trays 42 being as a unit moved vertically, and the recording paper 2 which is being continuously output by the sorter roller being sequentially received on separate sorter trays 42.

According to the aforementioned known example shown in FIG. 18, the edge portion of the paper eject tray 11 to the side of the outer paper ejecting roller 10 is positioned immediately below the outer paper ejecting roller 10 (B in FIG. 18). On the other hand, the edge of the sorter tray 42 cannot be positioned immediately below the sorter roller 41, since the sorter trays 42 are to be moved vertically. Accordingly, in order to improve the loadability, the ejecting speed has to be set at a certain speed or faster in order to kick the recording paper 2 out, so that the trailing end of the recording paper 2 completely is separated from the sorter roller 41.

FIG. 22 denotes an arrangement wherein a finisher 50 is attached to the paper eject unit of a color printer 100. The finisher 50 comprises folding means for folding the ejected recording paper and binding means for stacking a plurality of recording sheets and binding these (i.e., bookbinding means).

Now, description will be made regarding the binding means. The recording paper 2 transported by the outer paper ejecting roller 10 is guided to a first roller 51 by means of a flapper 51, and is ejected into a stack tray 54 by means of a second roller 53. The recording paper 2 is transported until it is pressed against a truing restricting plate 54*a* by means of unshown transporting means, each time a sheet is ejected onto the stack tray 54, thus forming a trued sheet stack. Once a trued sheet stack of one group of recording paper sheets has been formed, the stack is bound with staples 55, and is transported in the direction shown by the arrow E and is ejected on a first finisher tray 56.

Next, description will be given regarding the folding means. In the event that the flapper 51 is at the position shown by the broken line, the recording paper 2 transported by the outer paper ejecting roller 10 is guided to a third roller 57 and transported to a transporting path 58.

When the leading edge of the recording paper 2 abuts a stopper 58*a* of the transporting path 58, a jutting plate 59 moves in the direction shown by an arrow and presses the center portion of the recording paper 2 in the direction of transport. The recording paper 2 is bent into two from the center portion in the transporting direction as can be seen from the recording paper 2*a* which is nipped by the nipping portion of the center folding roller 60, and output on a second finisher tray 61.

Also, a plurality of sheets of recording paper 2 may be stacked in the transport path 58 and bent in two by the center folding roller 60, even in a stacked state.

Further, a plurality of sheets of recording paper 2*a* can be bound at the center folding portion by means of unshown stapling means, thus forming a set of recording paper sheets.

With the known example, the post-paper-eject processing devices such as the sorter 40 or the finisher 50 need to correspond with the decreased transporting speed of the recording paper until the recording paper 2 passes through the outer paper ejecting roller 10.

Accordingly, driving switching means for dealing with the slow transporting speed are required for the post-paper-eject processing devices, resulting in increased costs.

Also, as described above, with the sorter 40, the ejecting speed has to be set at a certain speed or faster in order to kick the recording paper 2 out, so that the trailing end of the recording paper 2 completely is separated from the sorter roller 41, and thus there is the need to increase the transporting speed once the recording paper 2 has passed through the fixing unit 8.

For example, in order to change the number of rotations of the motor as the aforementioned driving switching means, there is the need to change the number of rotations of the motor to a high rotation speed within the time from the trailing edge of the recording paper 2 passing the outer paper ejecting roller 10 to the trailing edge of the recording paper 2 passing the sorter roller 41, and in the event that the acceleration of the motor is not sufficient the distance between the outer paper ejecting roller 10 and the sorter roller 41 must be extended, this increasing the size of the apparatus.

Also, the post-paper-eject processing devices are constructed separately from the image forming apparatus, and are arranged so that the transporting speed thereof can be changed within a certain range, in order to allow common connection of the post-paper-eject processing devices to a plurality of types of image forming apparatuses.

For example, in order to allow connection of the post-paper-eject processing devices to image forming apparatuses with a transporting speed of 100 mm/s to image forming apparatuses with a transporting speed of 400 mm/s, the post-paper-eject processing devices are also provided with a driving system which is capable of changing the transporting speed from 100 mm/s to up to four times, 400 mm/s.

However, in the event that the transporting speed for OHP sheets or heavy paper is 25 mm/s, there is the need to accelerate the transporting speed of the post-paper-eject processing devices from 25 mm/s to 400 mm/s, which is acceleration of 16 times, and the driving motor which can be used for such is limited.

SUMMARY OF THE INVENTION

Accordingly, it is an object of the present invention to provide an image processing apparatus which can eject sheets at a speed which does not interfere with sheet loading, regardless of the transporting speed of the sheets when passing through the fixing means.

In order to solve the above problems, the construction of the present invention is an image forming apparatus, comprising: toner image forming means for forming a toner image on a sheet; fixing means for fixing a toner image formed by the aforementioned toner image forming means, while transporting the aforementioned sheet at a first transporting speed or a second transporting speed which is slower than the aforementioned first transporting speed; ejecting means for ejecting from the apparatus the sheet on which fixing has been performed by the aforementioned fixing means; and holding means for holding the aforementioned sheet between the aforementioned fixing means and the aforementioned ejecting means so that sheets subjected to fixing at the aforementioned second transporting speed can reach the aforementioned ejecting means after passing the aforementioned fixing means.

Also, it is another object of the present invention to provide an image processing apparatus which can eject sheets at a speed which does not interfere with the post-paper-eject processing devices, regardless of the transporting speed of the sheets when passing through the fixing means.

In order to solve the above problems, the construction of the present invention is an image forming apparatus, comprising: toner image forming means for forming a toner image on a sheet; fixing means for fixing a toner image formed by the aforementioned toner image forming means, while transporting the aforementioned sheet at a first transporting speed or a second transporting speed which is slower than the aforementioned first transporting speed; and ejecting means for ejecting from the apparatus the sheet on which fixing has been performed by the aforementioned fixing means; the aforementioned image forming apparatus being arranged such that processing devices which perform processing to the sheets ejected by the aforementioned ejecting means can be connected thereto; the aforementioned image forming apparatus further comprising holding means for holding the aforementioned sheet between the aforementioned fixing means and the aforementioned ejecting means so that sheets subjected to fixing at the aforementioned second transporting speed can reach the aforementioned ejecting means after passing the aforementioned fixing means.

DESCRIPTION OF THE PREFERRED EMBODIMENT

Figure 1:
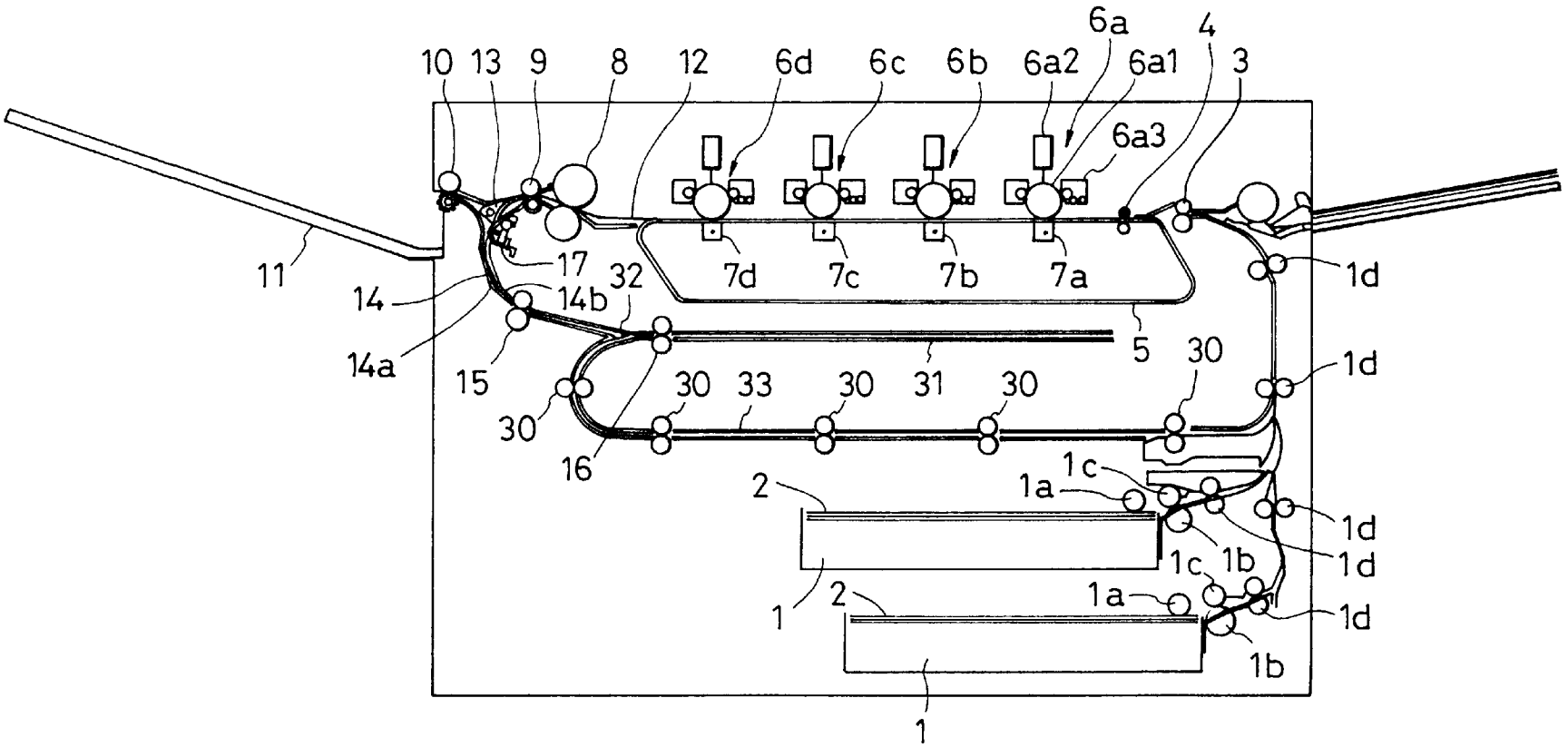
FIG. 1 is a diagram illustrating a first embodiment according to the present invention.

FIG. 1 is a diagram illustrating a first embodiment according to the present invention. As for the components which are the same as the known example, the same reference numerals will be provided and description thereof will be omitted.

In FIG. 1, In the event that image forming is to be performed to an OHP sheet 12, the position of the flapper 13 is switched over, the OHP sheet is guided into the reverse path 14 serving as holding means having OHP sheet guides 14*a* and 14*b*, and further is transported by the first transporting roller 15. At this time, fixing is performed to the OHP sheet at the transporting speed V1 (second transporting speed) which is slower than the normal transporting speed V (first transporting speed). For example, if the normal transporting speed V is 100 mm/s, V1 is 25 mm/s. However, this value does change according to the outer form of the fixing unit roller, the material thereof, the capabilities of the halogen heater, and so forth.

Figure 2:
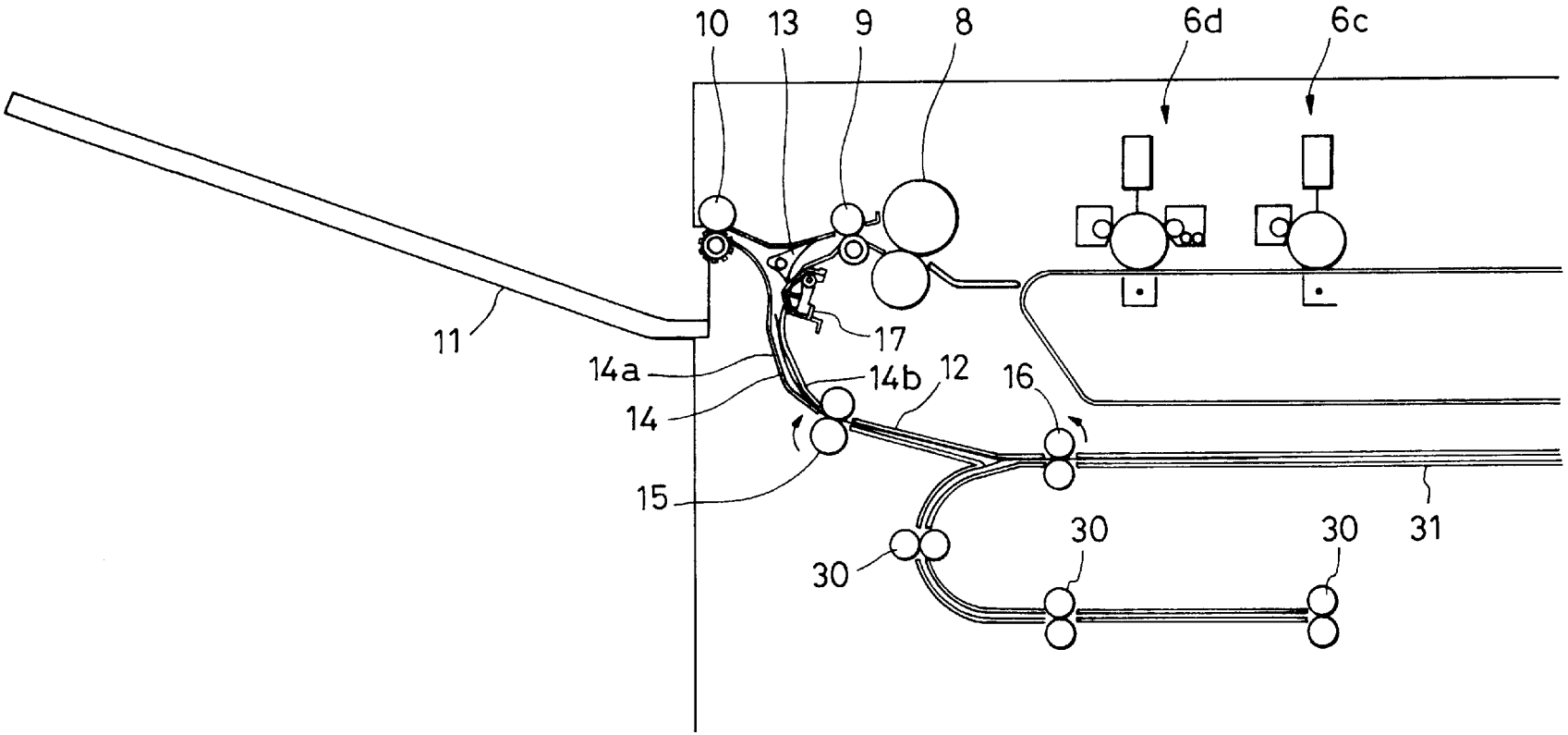
FIG. 2 is a diagram illustrating the operation of the first embodiment according to the present invention.

The OHP sheet guided to the reverse path 14 is transported by the first transporting roller 15 and the second transporting roller 16 until the trailing end thereof passes the flapper 13 (FIG. 2). At this time, the first transporting roller 15 and the second transporting roller 16 transport the OHP sheet 12 at speed V1. Once the trailing end thereof passes the fixing unit 8, there is no need to transport at V1, so transporting is performed at the normal speed V. Or, transporting may be performed at a speed faster than V.

Figure 3:
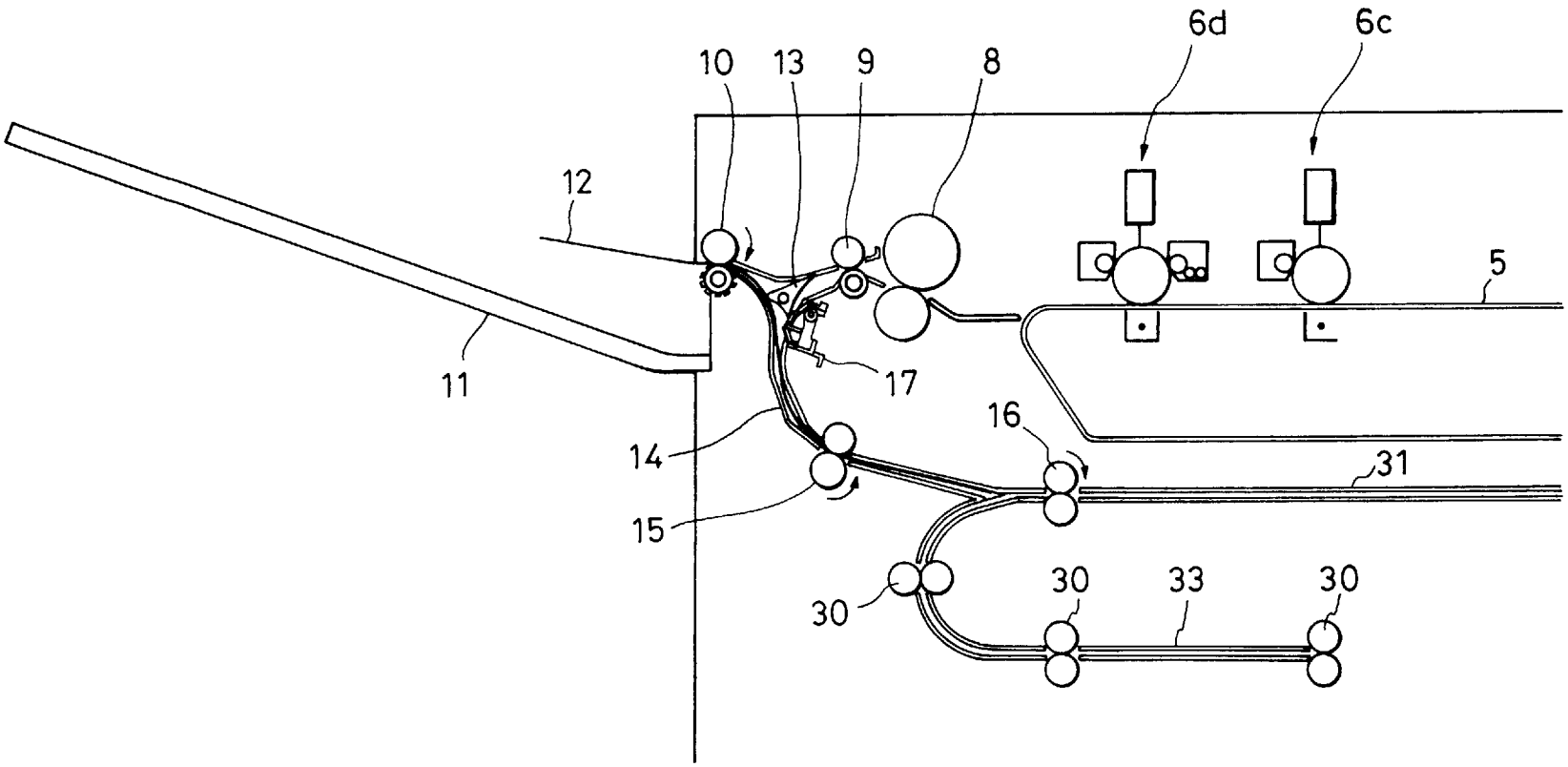
FIG. 3 is another diagram illustrating the operation of the first embodiment according to the present invention.

Once the OHP sheet passes the flapper 13, the first transporting roller 15 and the second transporting roller 16 are reverse rotated, switching back the OHP sheet 12. The OHP sheet 12 is guided to the ejecting roller 10 by means of the flapper 13, and is ejected onto the paper eject tray 11 (FIG. 3).

At this time, the transporting speed of the first transporting roller 15 and the second transporting roller 16, and the ejecting roller 10 is set at a speed V2 which is faster than V1. The speed V2 is set at a value such that ejecting can be completed before premature sagging of the OHP sheet 12 being ejected can occur, thus preventing curling.

The image forming apparatus shown in FIG. 1 has a both-side transporting path 33 for forming images on both sides, as described with regard to the known example. The flapper 13, reverse path 14, first and second transporting rollers 15 and 16, all are provided to the known example for forming images on both sides, but with the present invention, a reversal preventing flapper 17 is added, realizing the object thereof simply by switching the flapper 13 and controlling the first and second transporting rollers 15 and 16, etc. Accordingly, a program is added or changed in order to change the control procedures of the original control means, or new control means are added.

Also, in the present embodiment, the OHP sheet is ejected so that the face on which the image is formed is facing downwards. This is the same as face-down ejecting which is considered to be necessary for printers, and the objects here can be realized without changes in the mechanical construction simply by changing the control, as long as the image forming apparatus is capable of performing this face-down ejecting.

i.e., the face-down ejecting transporting path should be used in order to performing recording on OHP sheets.

Although the above description has been made with regard to OHP sheets, the same advantages can be obtained in the event that a sorter 18 is attached and heavy paper is used.

Figure 4:
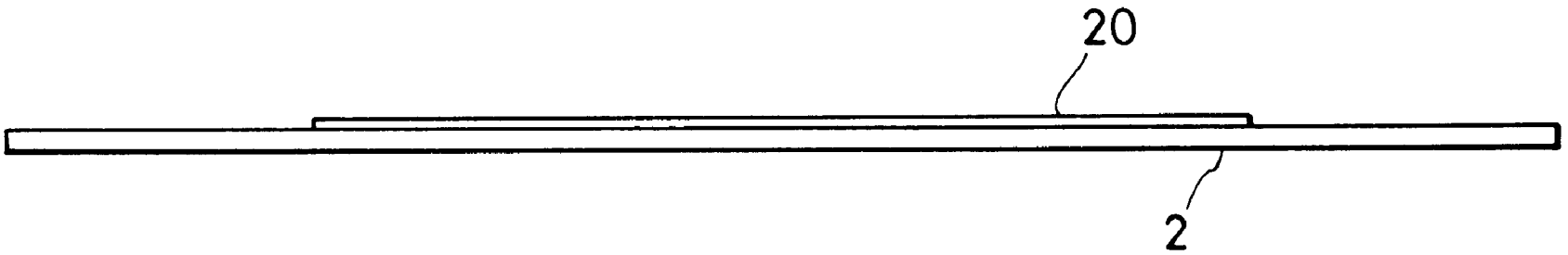
FIG. 4 is a diagram illustrating toner transferred into recording paper.

A second embodiment of the present invention will be described with reference to FIG. 4.

The toner 20 transferred into the recording paper 2 is heated and melted, and then subsequently solidifies by means of natural cooling. In this process of solidifying, the toner 20 shrinks in the direction shown by arrows A and B as compared to the melted state, so the recording paper curls in the direction shown in FIG. 5.

Figure 5:
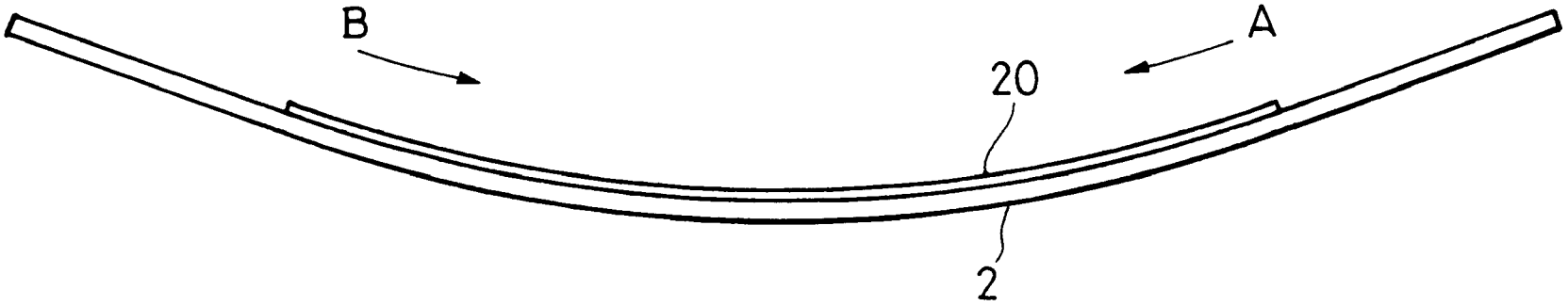
FIG. 5 is a diagram illustrating a sheet curling due to solidifying toner.

In order to prevent this curling, the guides 14*a* and 14*b* of the reverse path 14 to which the OHP sheet is guided following fixing are in a form so as to bow the OHP sheet 12 in the direction opposite to the curling direction shown in FIG. 5. Thus, the curling of the OHP sheet 12 due to toner shrinking is reduced.

Further, the transportation of the OHP sheet 12 may be stopped for a certain period of time in the state shown in FIG. 2. Causing solidifying of the toner in a state bowed in the opposite direction exhibits the effects of decreasing curling all the more.

Further, a arrangement may be employed wherein the stopping time is increased with increase in the toner amount on the OHP sheet 12, thus performing optimal curling correction. The amount of toner on the OHP sheet can be calculated from the image information signals used for image formation.

Also, means may be provided to determine the type of sheet being used, such as OHP sheet or photocopier paper, the thickness of the sheet, etc. Thus, changing the time span of stoppage can perform similarly optimal curling correction.

i.e., in the event that the stopping time in the sate of FIG. 2 is too long, the toner becomes solidified in the state shown in FIG. 2, and a curl following the curvature shown in FIG. 2 is formed in the paper. Accordingly, the stopping time should be determined according to the above-described conditions.

The above embodiment exhibits similar advantages using heavy paper, as well.

Figure 6:
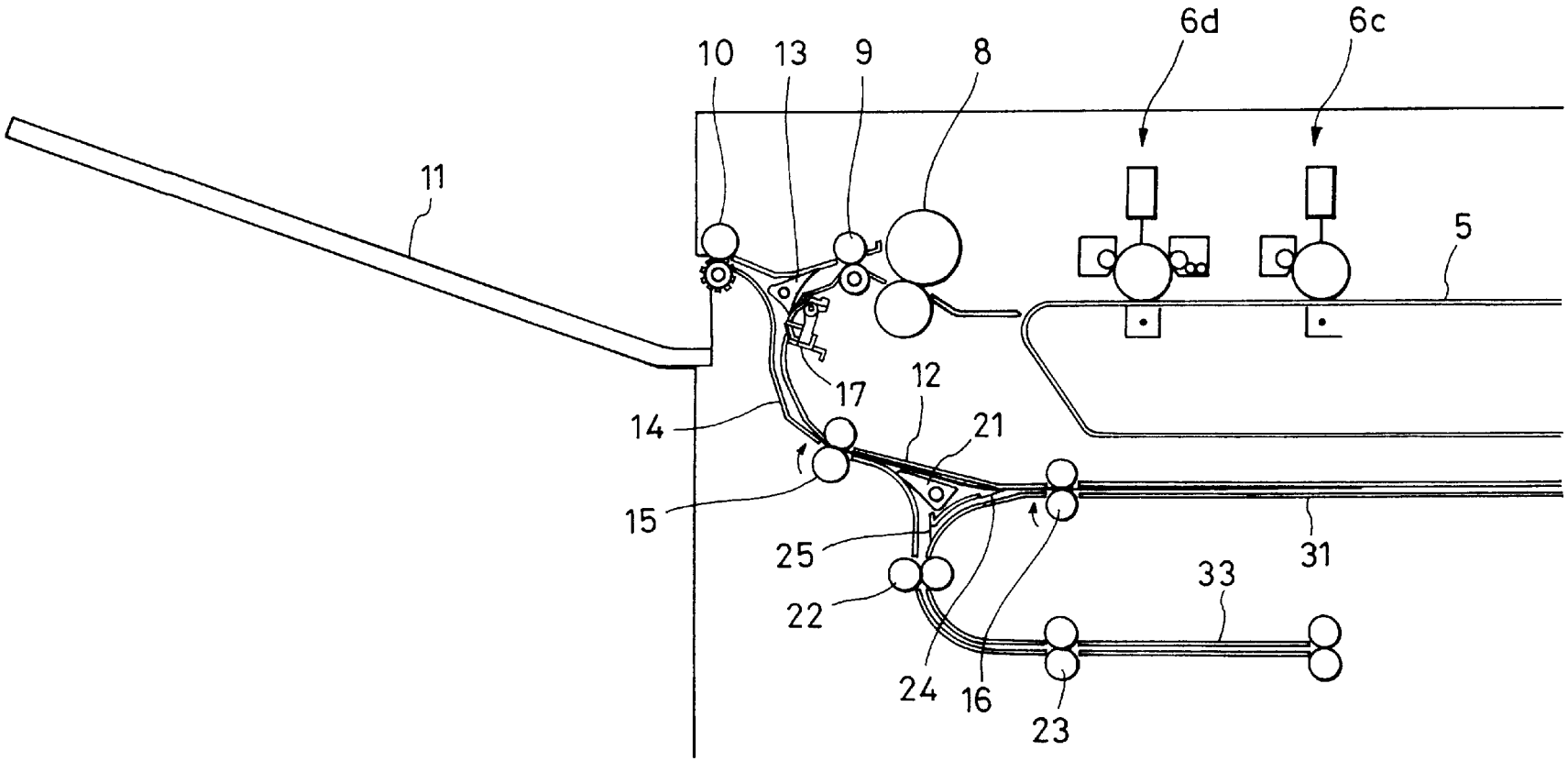
FIG. 6 is a cross-sectional diagram illustrating a third embodiment according to the present invention.

FIG. 6 is a diagram illustrating a third embodiment according to the present invention.

In FIG. 6, a second flapper 21 is provided between the first transporting roller 15 and the second transporting roller 16.

The sheet which has passed the fixing unit 8 is transported to the reverse path 14 by means of the flapper 13, is transported by the first transporting roller 15, guided to the switch-back path 31 by the second flapper 21, and is transported by means of the second transporting roller.

Figure 7:
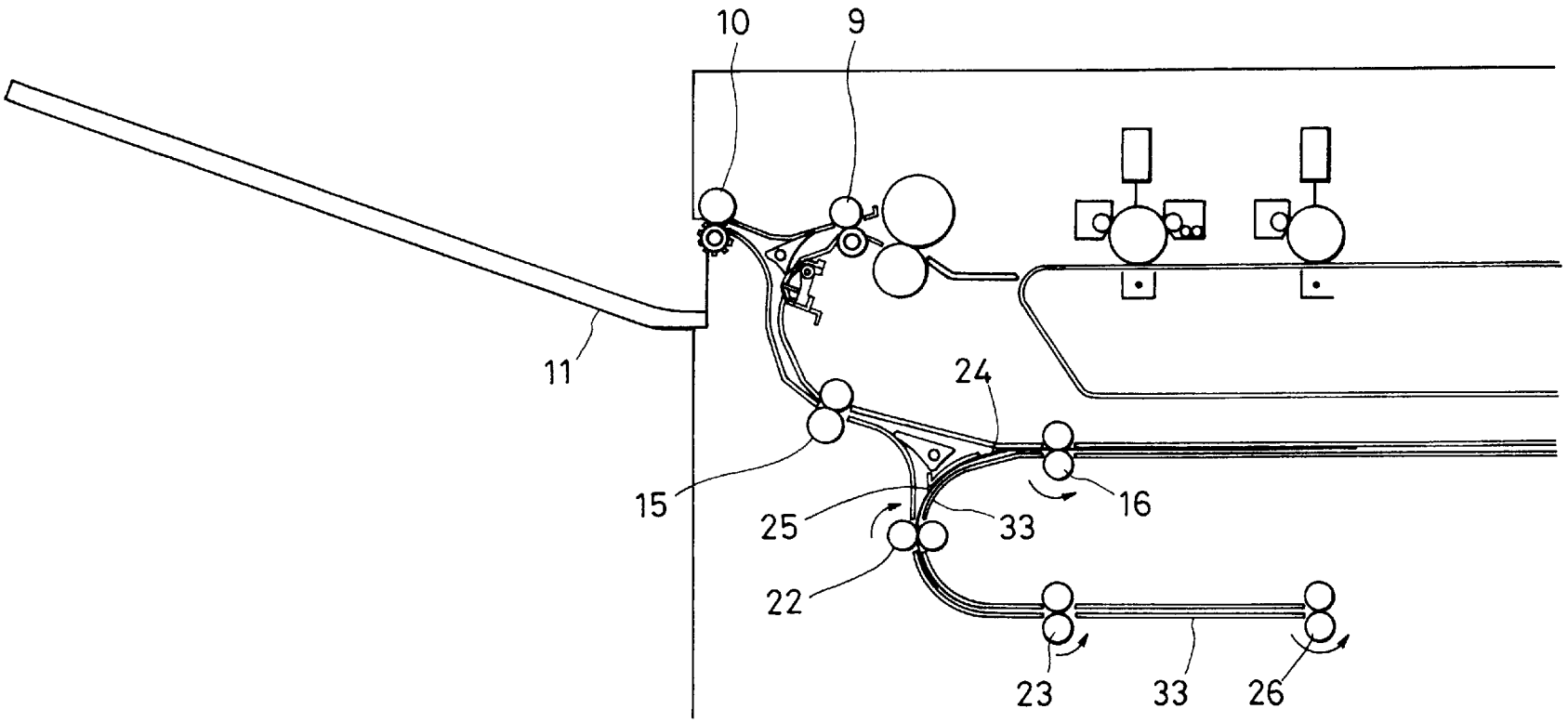
FIG. 7 is a cross-sectional diagram illustrating the operation of the third embodiment according to the present invention.

Subsequently, once the sheet passes the reverse preventing sheet 24, the second transporting roller is stopped temporarily. Next, the second transporting roller 16 is rotated in the reverse direction, guiding the sheet by the reverse preventing sheet 24 to the both-side transporting path 33 (FIG. 7). The sheet is transported by a third transporting roller 22, fourth transporting roller 23, and fifth transporting roller 26, and at the point that the trailing edge thereof passes the second reverse preventing sheet 25 as shown in FIG. 8, the third transporting roller 22, fourth transporting roller 23, and fifth transporting roller 26 are stopped.

Figure 8:
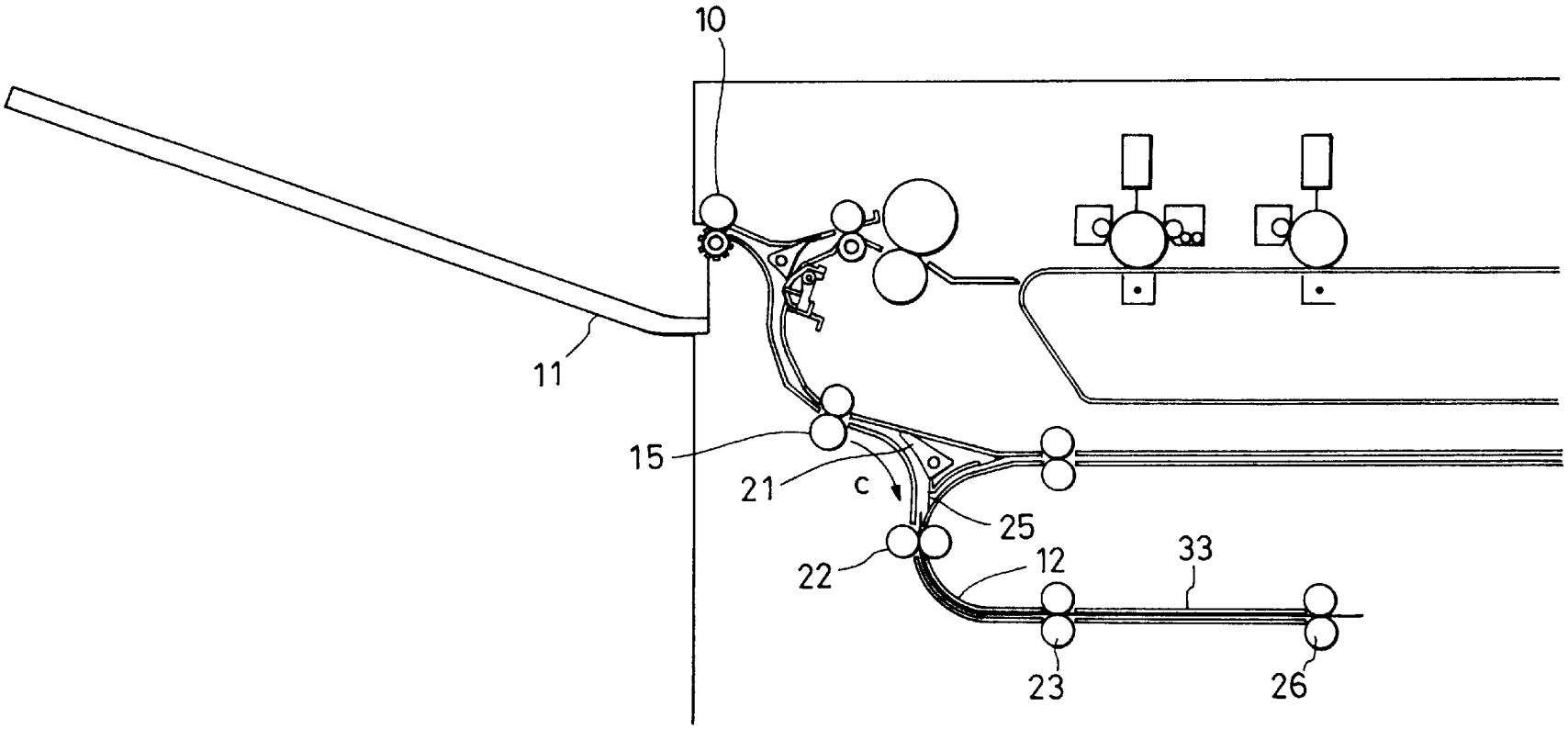
FIG. 8 is another cross-sectional diagram illustrating the operation of the third embodiment according to the present invention.

The transporting speed of the sheet from the time of the trailing edge of the sheet passing the fixing unit to the state of FIG. 8 is the same as that of the first embodiment and is faster than V1.

Next, in the state that the second flapper 21 has rotated to the position shown in FIG. 8 and switching over has been completed, the third transporting roller 22, fourth transporting roller 23, and fifth transporting roller 26 are rotated in the reverse direction, so that the leading end of the sheet is introduced to the reverse preventing sheet 25 and the second flapper 21, and further is transported to the first transporting roller which is being rotated in the reverse direction, and is ejected into the paper eject tray 11 by means of the outer paper ejecting roller 10.

The transporting speed at this time is V2, the same as that of the first embodiment.

In the present embodiment, the sheet is ejected onto the paper eject tray 11 with the image facing upwards. This is the same as being ejected in the same direction as being ejected in a normal manner from the inner paper ejecting roller 9 to the outer paper ejecting roller 10.

Also, in FIG. 8, 33 is a well known multiple transporting path, and image formation can be performed on both sides by transporting the sheet from the state shown in FIG. 8 to the transporting roller 1*d,* without reversing the rotation of the third transporting roller 22, fourth transporting roller 23, and fifth transporting roller 26.

i.e., the present embodiment uses the transport path construction of a known image forming apparatus capable of multiple image forming on both sides, so there is no need to provide a special transporting path.

Figure 9:
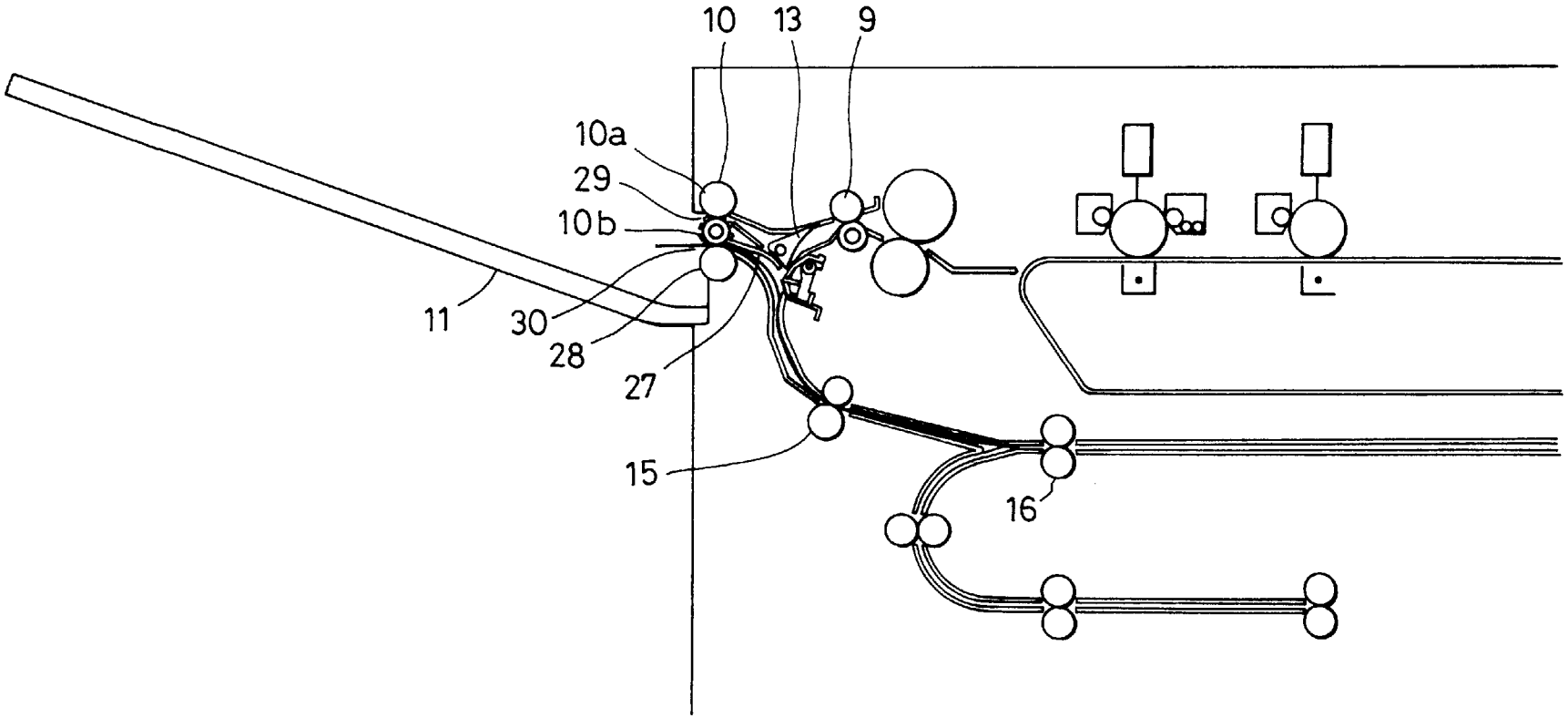
FIG. 9 is a diagram illustrating a fourth embodiment according to the present invention.

FIG. 9 is a diagram illustrating a fourth embodiment of the present invention, with a guide 27 being provided between the first flapper 13 and the outer paper ejecting roller 10 of the first embodiment, further provided with a following outer paper ejecting roller 28 which presses the driving outer paper ejecting roller 10 of the following outer paper ejecting roller 10*a* and the driving outer paper ejecting roller 10*b,* and further provided with a second paper ejecting opening 30 formed by the outer paper ejecting roller 10*b* and the roller 28.

Toner fixed onto recording paper binds with the fibers of the recording paper by means of melting, but the OHP sheets are formed of PET material, and so the adhesion thereof is poor.

Accordingly, toner is peeled off when the recording surface thereof is rubbed by a rubber driving paper ejecting roller 10*b*.

Also, the outer ejecting roller 10 has a transporting speed which is faster than that of the inner paper ejecting roller 9, so the outer ejecting roller 10 rubs against the recording sheet.

Since the driving outer paper ejecting roller 10*b* is formed of rubber, there is some degree of shaving which occurs, leaving rub marks on the recording sheet. Accordingly, the arrangement should be such that does not leave such marks on the recording surface.

With the present embodiment, in a normal state, of paper ejecting from the inner paper ejecting roller 9 to the outer paper ejecting roller 10, the driving outer paper ejecting roller 10*b* is in contact wit the reverse side of the recording surface. In the case of recording sheets of a slow transporting speed such as OHP sheets, the sheet is transported inside once and then is ejected at a fast speed, in which cases the sheet is ejected form the second ejecting opening 30, so the driving outer paper ejecting roller 10*b* come into contact with the reverse side from the recording face. The driving outer paper ejecting roller 10*b* is of a construction capable of driving in the reverse direction at this time.

According to the above embodiments, an image forming apparatus can be provided wherein sheets can be output at a speed which does not interfere with stacking of the sheets, regardless of the transporting speed of the sheets passing through the fixing means.

Figure 10:
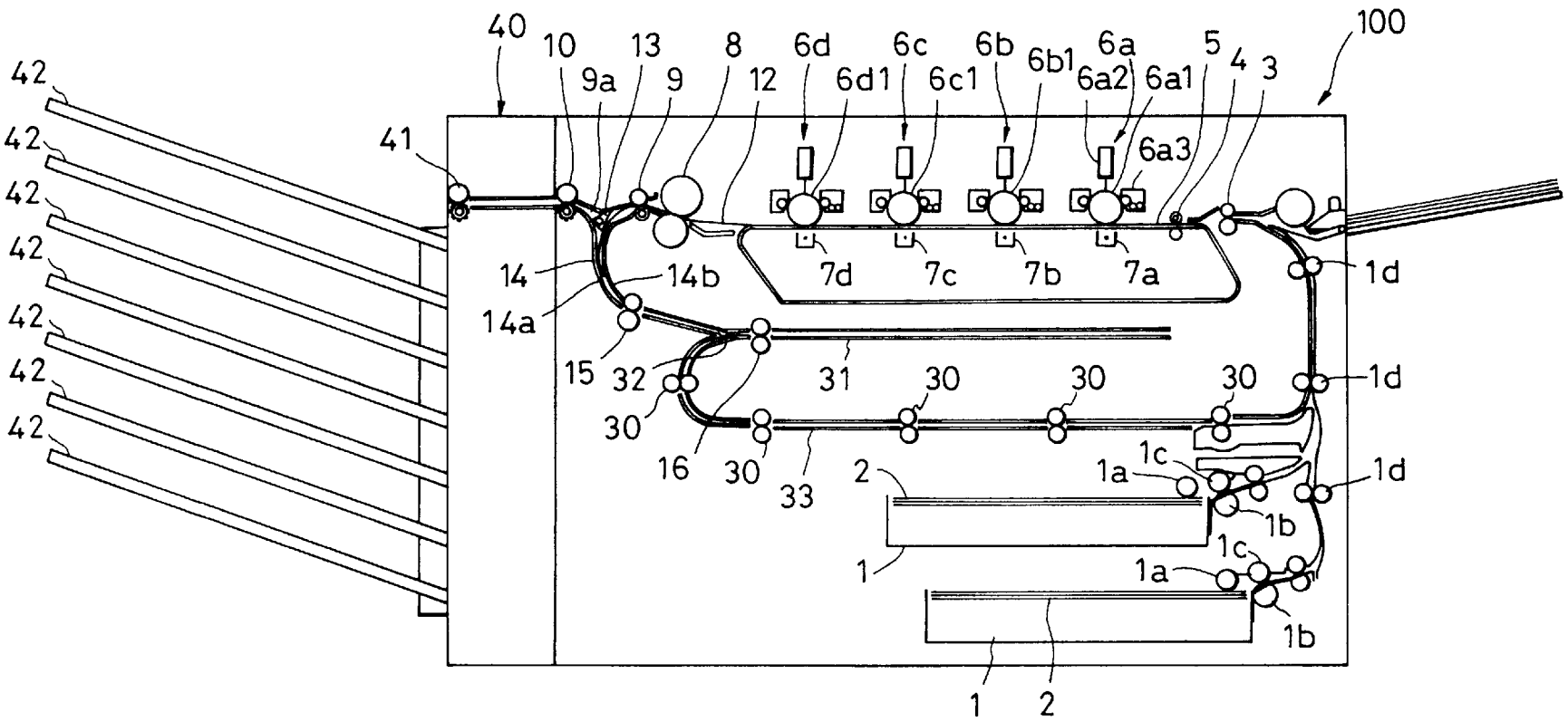
FIG. 10 is a diagram illustrating a fifth embodiment according to the present invention.

FIG. 10 is an diagram illustrating a fifth embodiment of the present invention. For the components which are the same as those of the known example, the same reference numerals are provided and description thereof is omitted.

A sorter 50 serving as a processing device is provided to the paper eject unit of a color printer 100 serving as an image forming apparatus.

Figure 18:
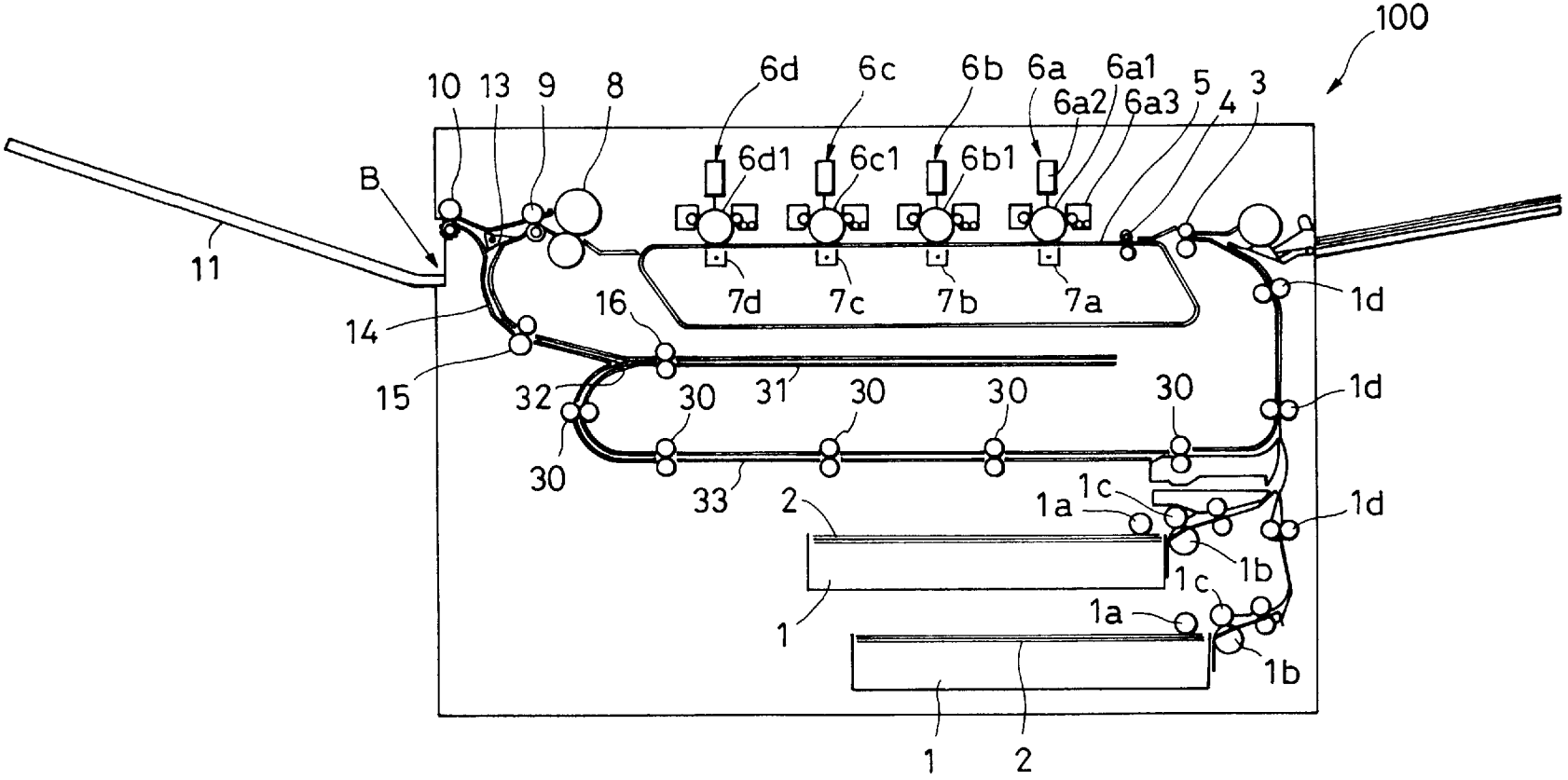
FIG. 18 is a diagram illustrating a known color printer.
Figure 19:
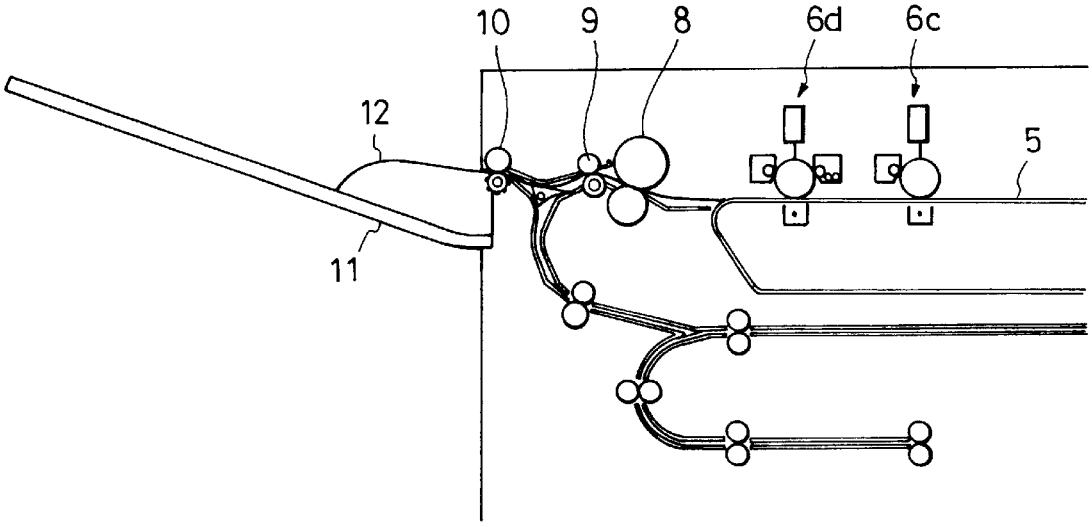
FIG. 19 is a diagram illustrating the paper ejecting unit of a known color printer.
Figure 20:
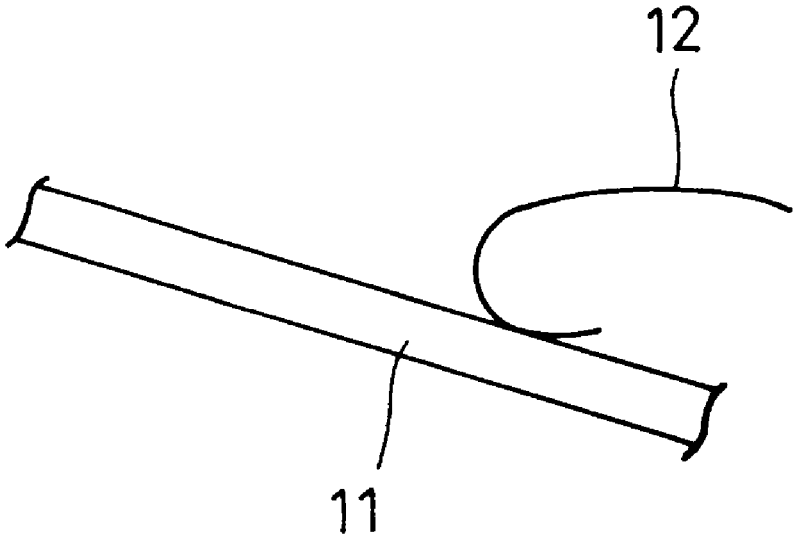
FIG. 20 is another diagram illustrating the paper ejecting unit of a known color printer.
Figure 21:
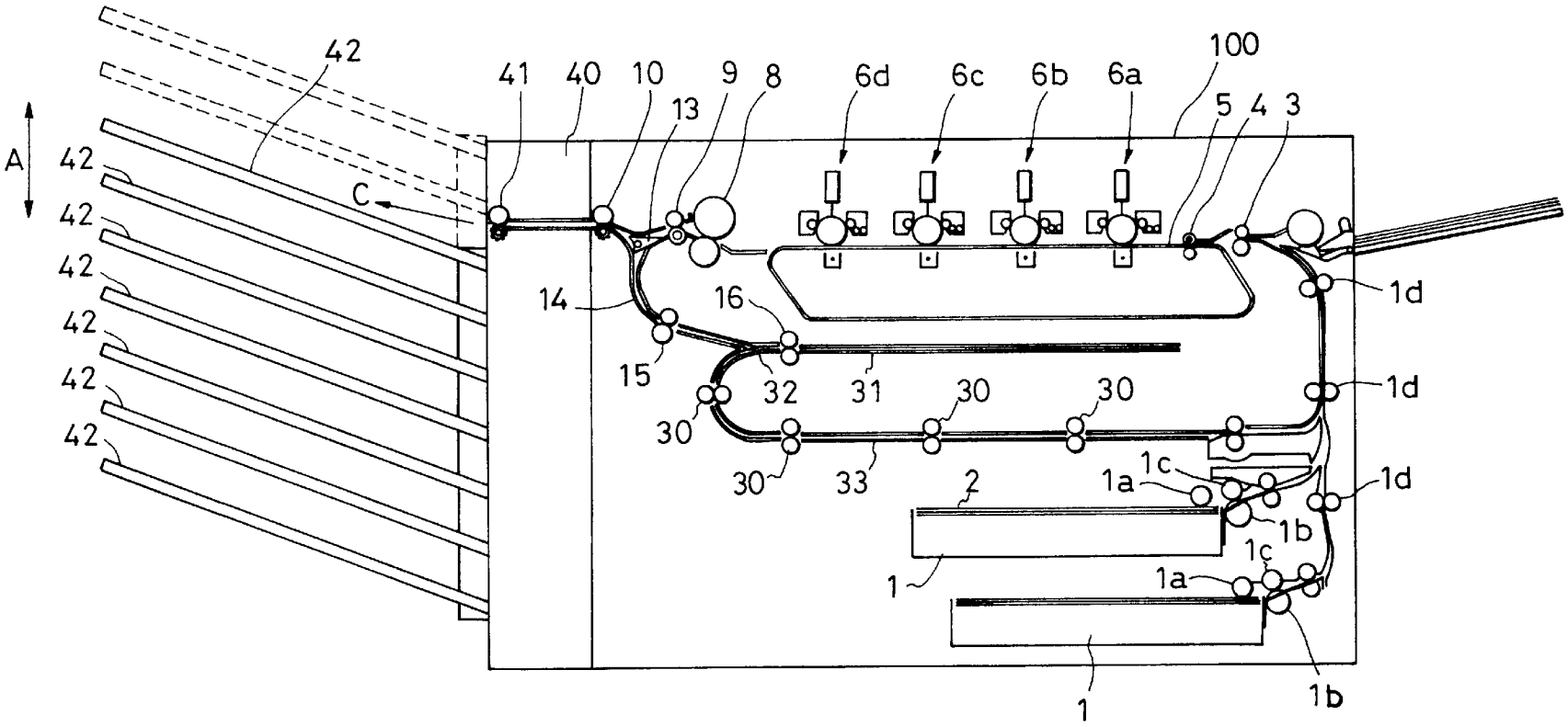
FIG. 21 is a diagram illustrating a known color printer to which a sorter has been connected to the paper ejecting unit.
Figure 22:
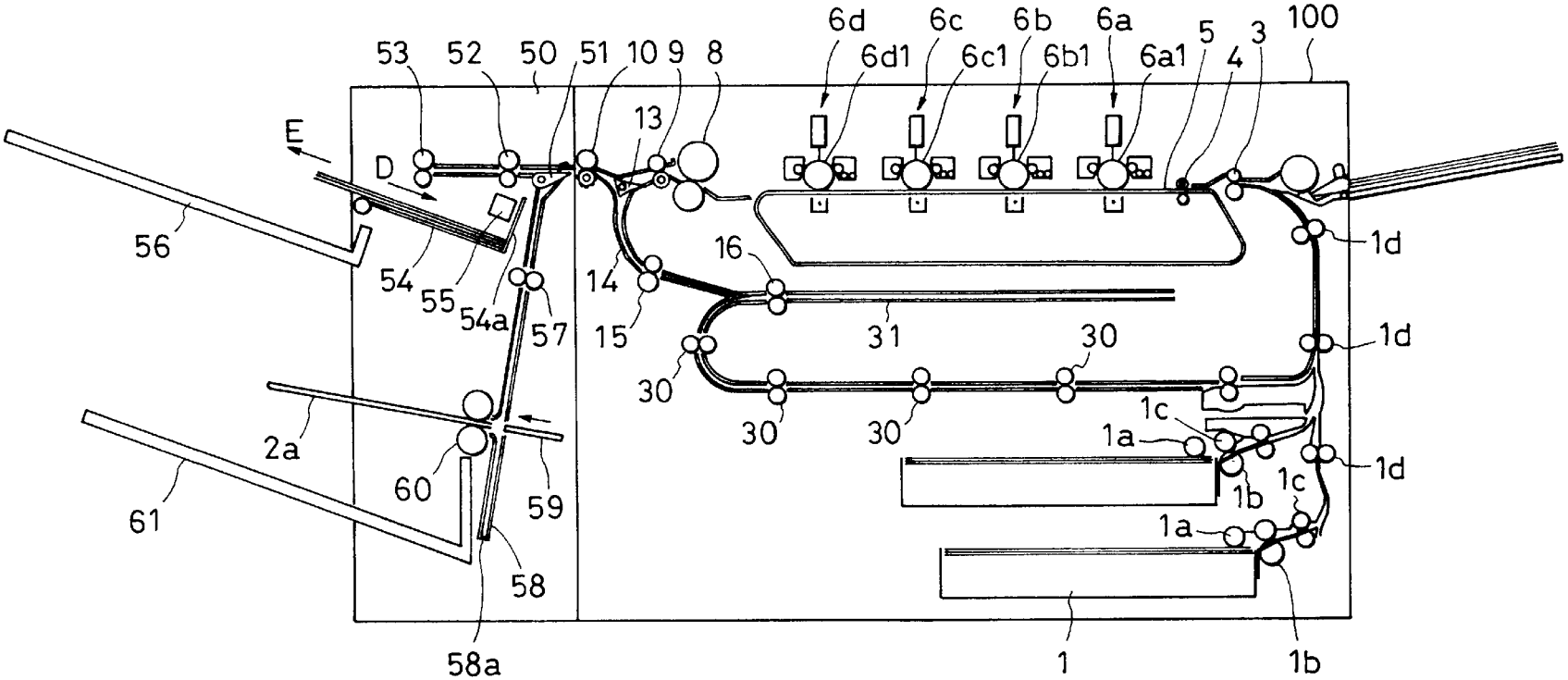
FIG. 22 is a diagram illustrating a known color printer to which a finisher has been connected to the paper ejecting unit.

In the event of performing image forming on standard photocopying paper in FIG. 10, the flapper 13 is set at the position as shown in FIG. 18, so that the sheet being transported at a standard transporting speed V while being subjected to fixing by the fixing roller 8 is guided from the inner paper ejecting roller 9 to the first transporting path 9*a,* and then is guided to the outer paper ejecting roller 10.

In FIG. 10, in the event that image forming is to be performed to an OHP sheet 12, the position of the flapper 13 is switched over, the OHP sheet is guided into the reverse path 14 serving as holding means having OHP sheet guides 14*a* and 14*b,* and further is transported by the first transporting roller 15. At this time, fixing is performed to the OHP sheet at the transporting speed V1 (second transporting speed) which is slower than the normal transporting speed V (first transporting speed). For example, if the normal transporting speed V is 100 mm/s, V1 is 25 mm/s. However, this value does change according to the outer form of the fixing unit roller, the material thereof, the capabilities of the halogen heater, and so forth.

Figure 11:
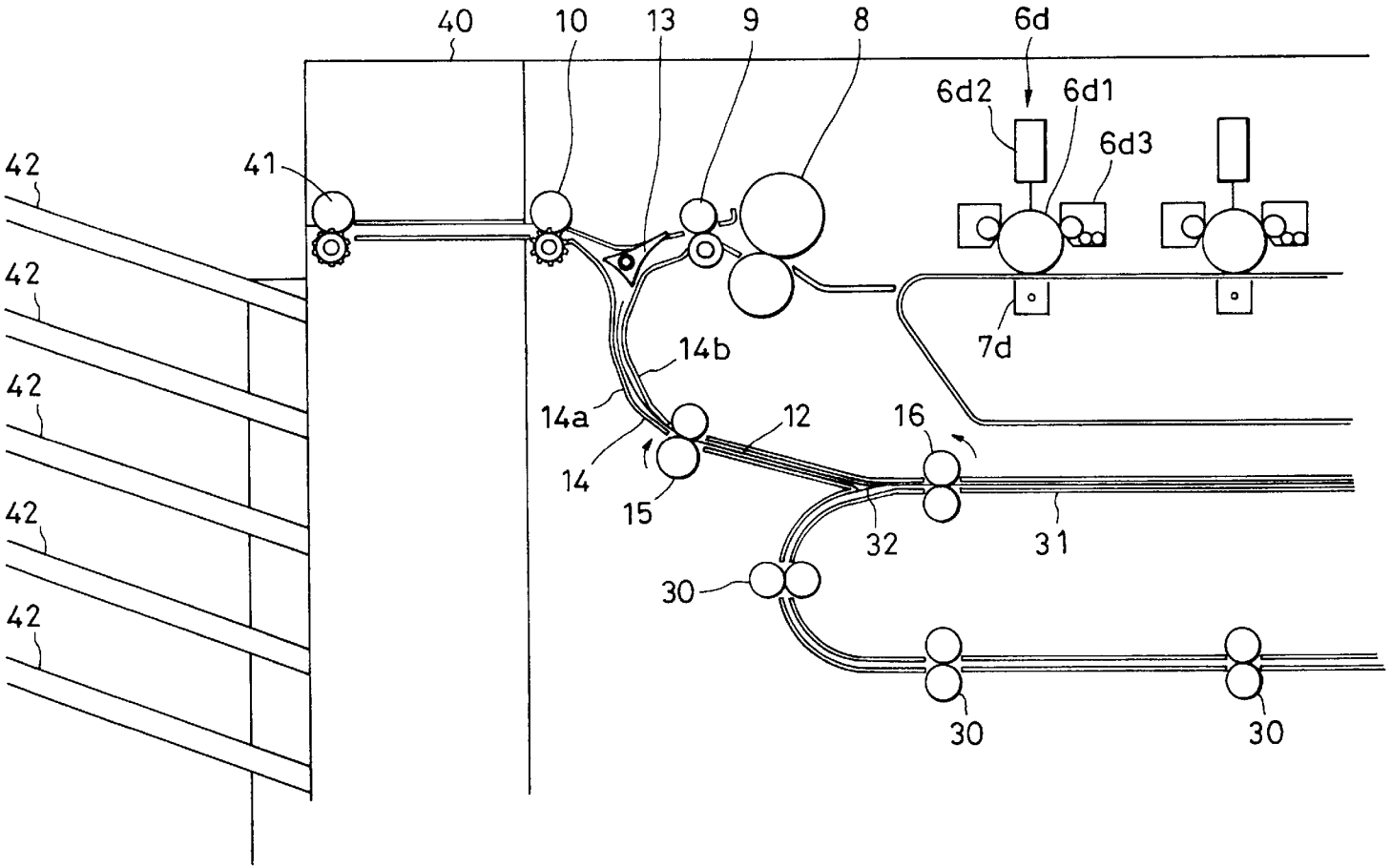
FIG. 11 is a diagram illustrating the operation of the fifth embodiment according to the present invention.

The OHP sheet guided to the reverse path 14 is transported by the first transporting roller 15 and the second transporting roller 16 serving as switch-back means until the trailing end thereof passes the flapper 13 (FIG. 11). At this time, the first transporting roller 15 and the second transporting roller 16 transport the OHP sheet 12 at speed V1 until the trailing end of the OHP sheet 12 passes the fixing unit 8. Once the trailing end thereof passes the fixing unit 8, there is no need to transport at V1, so transporting is performed at the normal speed V. Or, transporting may be performed at a speed faster than V.

Figure 12:
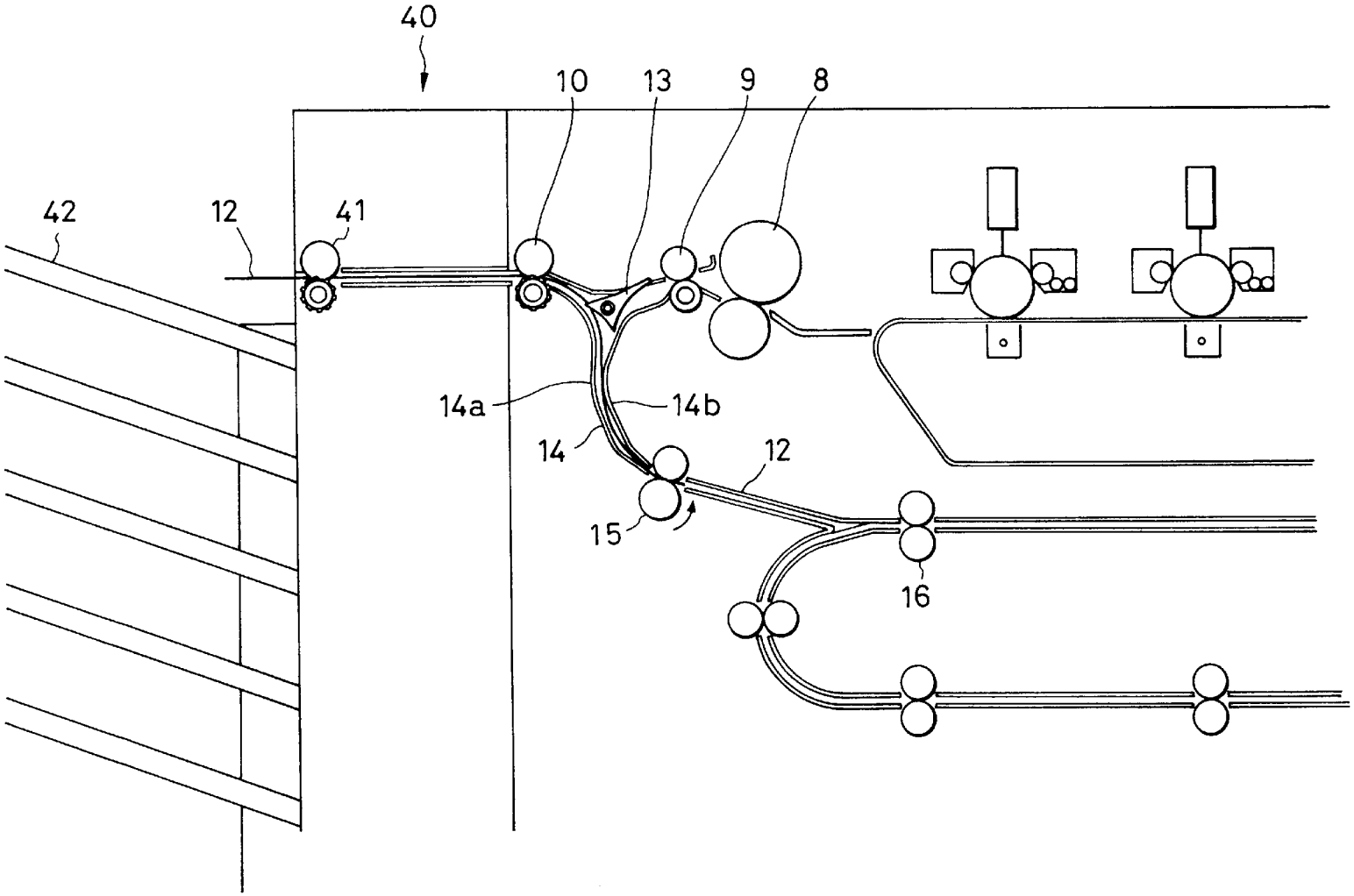
FIG. 12 is another diagram illustrating the operation of the fifth embodiment according to the present invention.

Once the OHP sheet passes the flapper 13, the first transporting roller 15 and the second transporting roller 16 are reverse rotated, switching back the OHP sheet 12. The OHP sheet 12 is guided to the ejecting roller 10 by means of the flapper 13, and is delivered to the sorter 40 which serves as a processing means having sorting means, and is ejected onto one of a plurality of sorter trays 42 by means of the sorter roller 41 (FIG. 12).

At this time, the transporting speed of the first transporting roller 15 and the second transporting roller 16, and the ejecting roller 10 is set at a speed V2 which is faster than V1. The speed V2 is set at a value such that ejecting can be completed before premature sagging of the OHP sheet 12 being ejected can occur, thus preventing curling. Also, the speed V2 is such that the sorter 40 can deal with.

Also, in the present embodiment, the OHP sheet is ejected so that the face on which the image is formed is facing downwards. This is the same as face-down ejecting which is considered to be necessary for printers, and the objects here can be realized without changes in the mechanical construction simply by performing this control for OHP sheets of heavy paper when a paper-eject processing device is attached, as long as the image forming apparatus is capable of performing this face-down ejecting.

The image forming apparatus shown in FIG. 10 has a both-side transporting path 33 for forming images on both sides, as described with regard to the known example. The flapper 13, reverse path 14, first and second transporting rollers 15 and 16, etc. all are provided to the known example for forming images on both sides, realizing the object of the present invention simply by switching the flapper 13 and controlling the first and second transporting rollers 15 and 16, etc. Accordingly, a program is added or changed in order to change the control procedures of the original control means, or new control means are added.

A sixth embodiment according to the present invention will be described with reference to FIG. 13.

Figure 13:
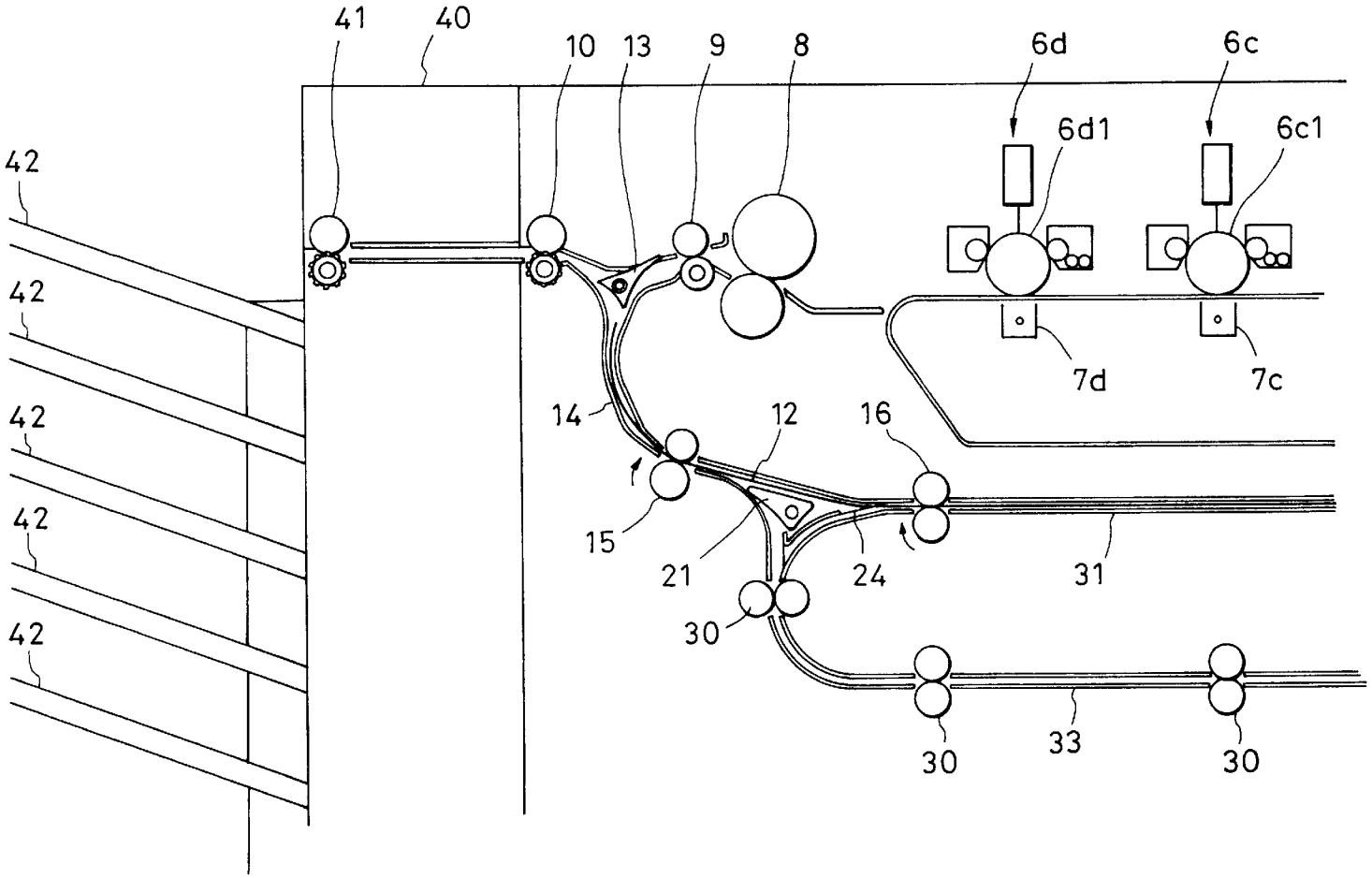
FIG. 13 is a diagram illustrating a sixth embodiment according to the present invention.

In FIG. 13, a second flapper 21 is provided between the first transporting roller 15 and the second transporting roller 16.

The sheet which has passed the fixing unit 8 is transported to the reverse path 14 by means of the flapper 13, is transported by the first transporting roller 15, guided to the switch-back path 31 by the second flapper 21, and is transported by means of the second transporting roller 16.

Figure 14:
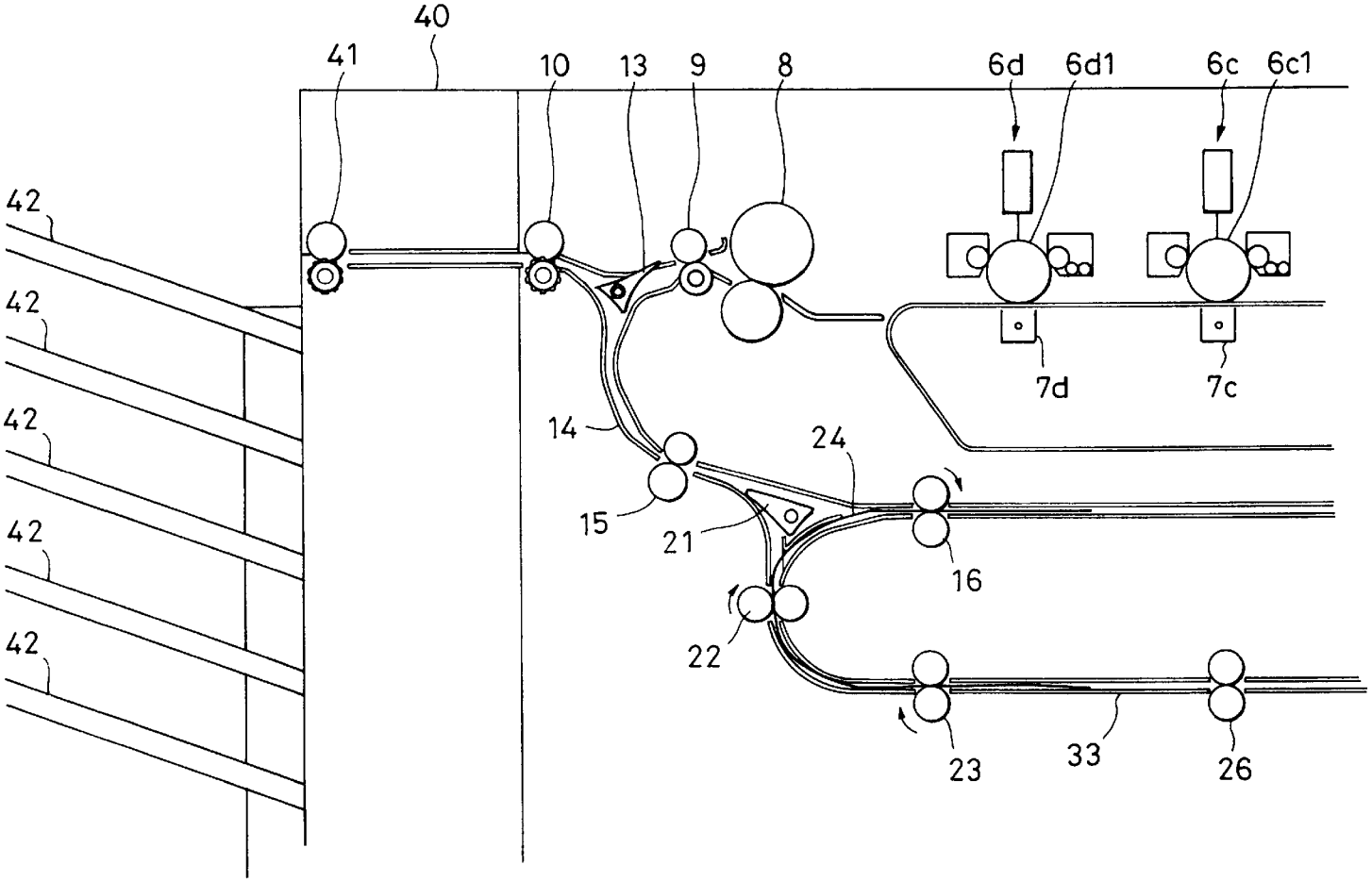
FIG. 14 is another diagram illustrating the sixth embodiment according to the present invention.

Subsequently, once the sheet passes the reverse preventing sheet 24, the second transporting roller is stopped temporarily. Next, the second transporting roller 16 is rotated in the reverse direction, guiding the sheet by the reverse preventing sheet 24 to the both-side transporting path 33 (FIG. 14). The sheet is transported by a third transporting roller 22, fourth transporting roller 23, and fifth transporting roller 26, and at the point that the trailing edge thereof passes the second reverse preventing sheet 25 as shown in FIG. 15, the third transporting roller 22, fourth transporting roller 23, and fifth transporting roller 26 are stopped.

Figure 15:
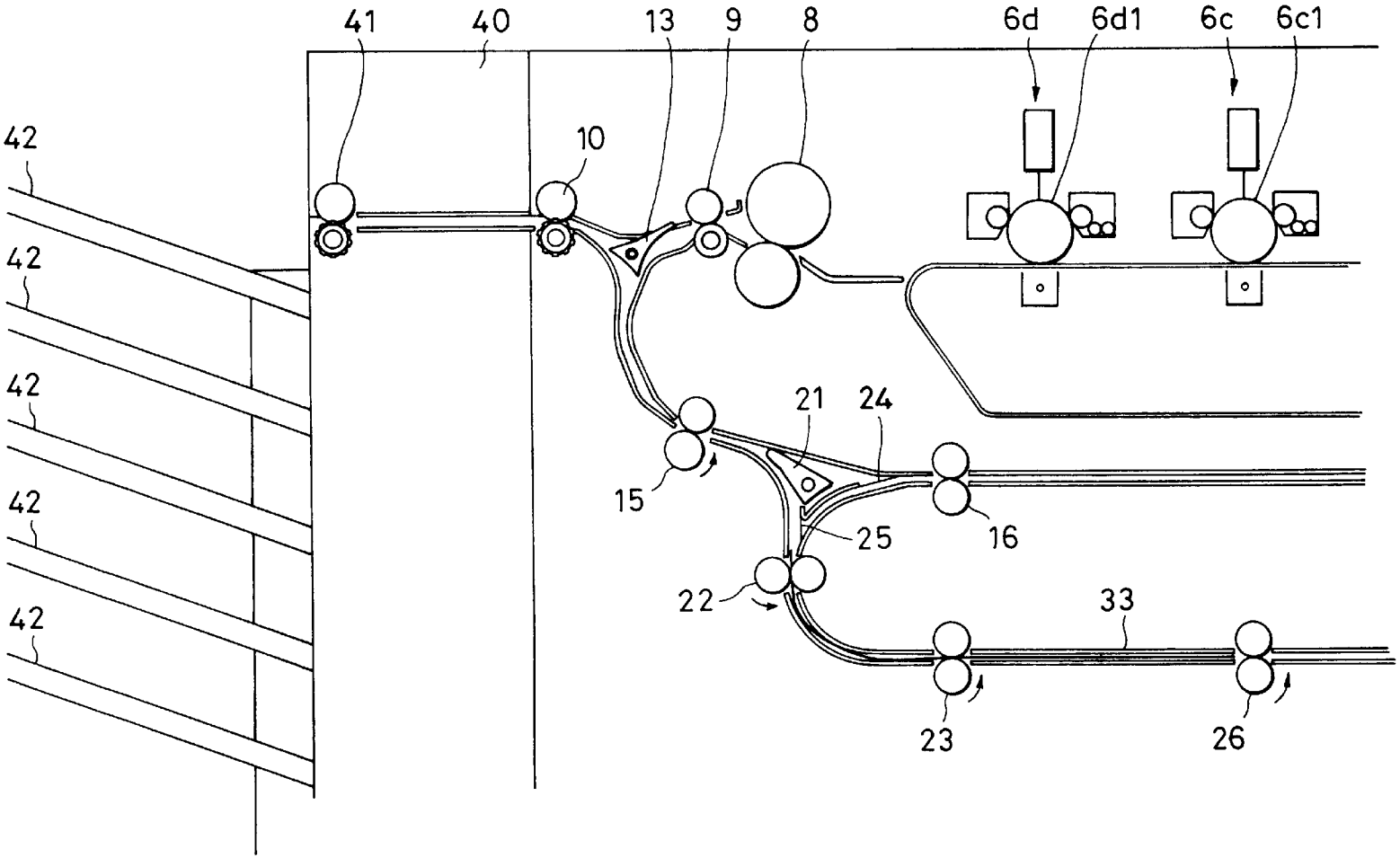
FIG. 15 is yet another diagram illustrating the sixth embodiment according to the present invention.

The transporting speed of the sheet from the time of the trailing edge of the sheet passing the fixing unit to the state of FIG. 15 is the same as that of the fifth embodiment and is faster than V1.

Next, in the state that the second flapper 21 has rotated to the position shown in FIG. 15 and switching over has been completed, the third transporting roller 22, fourth transporting roller 23, and fifth transporting roller 26 are rotated in the reverse direction, so that the leading end of the sheet is introduced to the reverse preventing sheet 25 and the second flapper 21, and further is transported to the first transporting roller which is being rotated in the reverse direction, and is fed to the sorter 40 by means of the outer paper ejecting roller 10.

The transporting speed at this time is V2, the same as that of the fifth embodiment.

In the present embodiment, the sheet is ejected onto the sorter tray 42 of the sorter 40 with the image facing upwards. This is the same as being ejected in the same direction as being ejected in a normal manner from the inner paper ejecting roller 9 to the outer paper ejecting roller 10.

Also, in FIG. 15, 33 is a well known multiple transporting path, and image formation can be performed on both sides by transporting the sheet from the state shown in FIG. 15 to the transporting roller 1*d,* without reversing the rotation of the third transporting roller 22, fourth transporting roller 23, and fifth transporting roller 26. Also, an image can be formed again on the same face as the face to which the previous image was formed, by means of leaving the second flapper 21 in the position shown in FIG. 15, and transporting the sheet from the first transporting opening to the transporting roller id, without reversing the rotation of the third transporting roller 22, fourth transporting roller 23, and fifth transporting roller 26.

i.e., the present embodiment uses the transport path construction of a known image forming apparatus capable of multiple image forming on both sides, so there is no need to provide a special transporting path.

Figure 16:
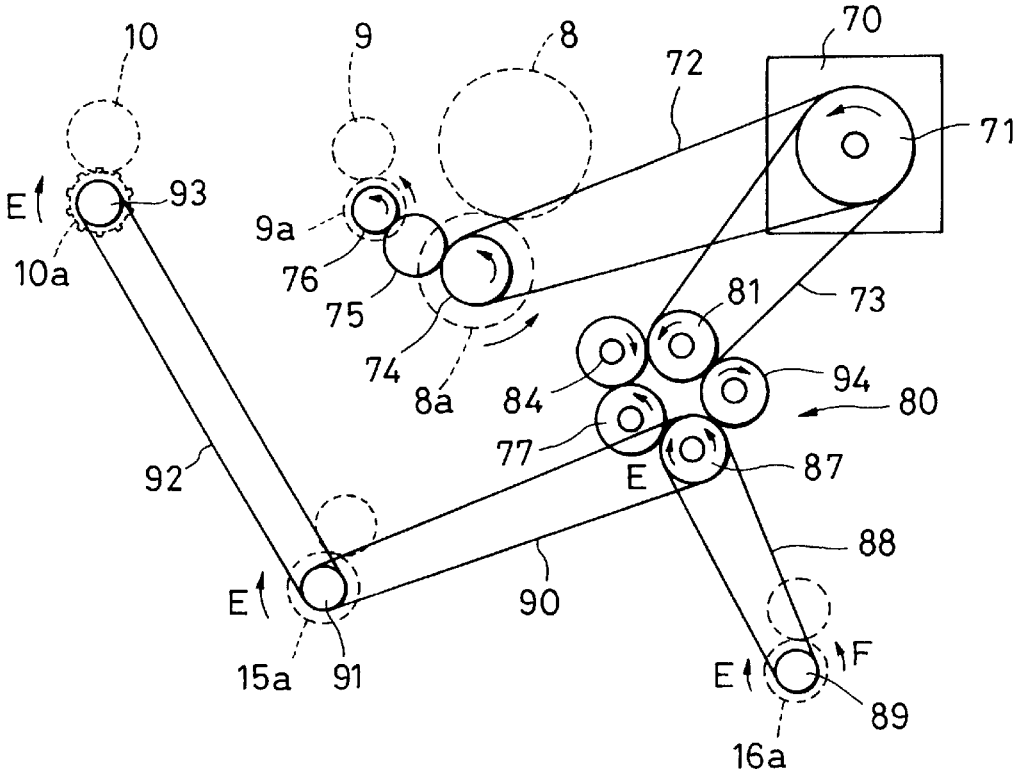
FIG. 16 is a diagram illustrating a seventh embodiment according to the present invention.
Figure 17:
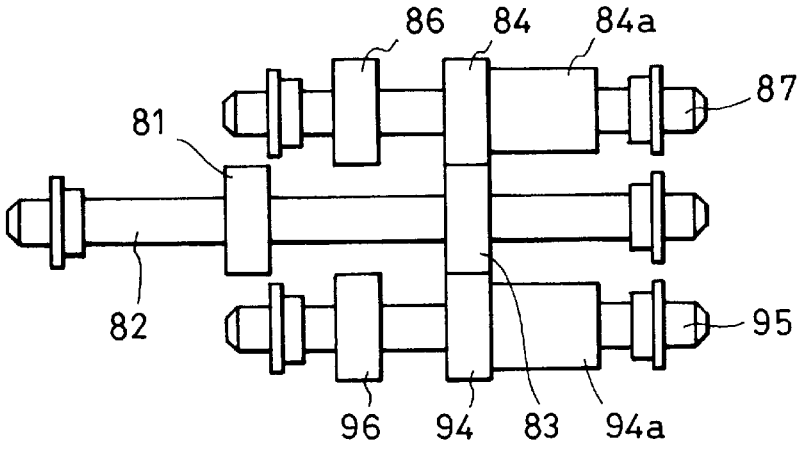
FIG. 17 is another diagram illustrating the seventh embodiment according to the present invention.

FIG. 16 and FIG. 17 are diagrams of the driving system of the rollers of the seventh embodiment according to the present invention.

A pulley 71 is attached to a motor 70, a fixed roller pulley 74 is driven by means of a belt 72, and a driving side fixing roller 8*a* having a common rotational shaft with the fixing roller pulley 74 is rotated. The fixing roller pulley 74 has an unshown fixing roller gear provided on the same shaft, with this gear engaging a gear 76.

The driving of the motor 70 transferred to the fixing roller pulley is transferred to the gear 76 provided on the same shaft as with a driving side inner paper ejecting roller 9*a,* via a fixing roller gear.

Also, driving is transferred from the pulley 71 to a driving direction switching unit 80 by means of the belt 73.

The belt 73 rotates the pulley 81. A pulley 80 is provided on a shaft 82. Provided to the shaft 82 is a gear 83 provided with a single-directional rotating clutch. The single-directional rotating clutch is constructed so as to transfer the driving force to the gear 83 when in the shaft 82 is rotating in a counter-clockwise direction as shown in FIG. 7, thus causing counter-clockwise rotation of the gear 83.

The gear 83 is meshed with a gear 84 on the input side of an electromagnetic clutch 84*a,* and when the electromagnetic clutch 84*a* is turned on, the driving force transferred to the gear 84 is transferred to a shaft 85, thus rotating a gear 86.

An unshown pulley gear meshing with the gear 77 is provided to the rotating shaft of the pulley 87, and the rotation of the gear 86 is transferred to the pulley 87 via the gear 77 and this unshown pulley gear.

The gear 83 is meshed with a gear 94 on the input side of an electromagnetic clutch 94*a,* and when the electromagnetic clutch 94*a* is turned on, the driving force transferred to the gear 94 is transferred to a shaft 95, thus rotating a gear 96.

A further unshown second pulley gear meshing with the gear 96 is provided to the rotating shaft of the pulley 87, and the rotation of the gear 86 is transferred to the pulley 87 via the gear 96 and this unshown second pulley gear.

A pulley 89 is provided to the rotation shaft of the second transporting roller 16*a* on the driving side, and a belt 88 is hung on the pulley 87 and pulley 89. The rotation of the pulley 87 is transferred to the second transporting roller 16*a* via the belt 88 and the pulley 89.

A pulley 91 is provided to the rotation shaft of the first transporting roller 15*a* on the driving side, and a pulley 93 is provided to the rotation shaft of the outer paper ejecting roller 10*a* on the driving side. A belt 92 is hung on the pulley 87 and pulley 91. The rotation of the pulley 87 is transferred to the first transporting roller 15*a* via the belt 90 and the pulley 91, and further is transferred to the outer paper ejecting roller 10*a* via the belt 92 and the pulley 93.

Rotating the motor 70 in a counter-clockwise direction rotates the driving side fixing roller 8*a* and the driving side inner paper ejecting roller 9*a* in a counter-clockwise direction.

At this time, turning the electromagnetic clutch 84*a* on and turning the electromagnetic clutch 94*a* off causes the driving force transferred to the pulley 81 to be transferred to the pulley 87 via the gear 84 and gear 77, so that the pulley 87 rotates in the direction shown by the arrow E, thus rotating the first transporting roller 15*a,* second transporting roller 16*a,* and outer paper ejecting roller 10*a* each n the direction shown by the arrow E.

Also, turning the electromagnetic clutch 84*a* off and turning the electromagnetic clutch 94*a* on causes the driving force transferred to the pulley 81 to be transferred to the pulley 87 via the gear 94, so that the pulley 87 rotates in the direction shown by the arrow F, thus rotating the first transporting roller 15*a,* second transporting roller 16*a,* and outer paper ejecting roller 10*a* each n the direction shown by the arrow F.

Thus, the direction of rotation of each roller can be changed by the operation of a single motor 70 and two electromagnetic clutches 84*a* and 94*a*. Only one motor is needed, so the cost can be reduced markedly.

However, in the event that the transporting speed of the fixing roller is set at V1, the transporting speed of the outer paper ejecting roller 10, and the first and second transporting rollers also becomes V1, and transport to a post-paper ejecting processing device such as the sorter of the present embodiment cannot be performed at a speed V2.

When the recording paper which had been being transported at speed V1 by means of the outer paper ejecting roller 10 or the like reaches the sorter roller 41, the recording paper is pulled at a speed generally V2 since the sorter roller 41 attempts to transport the recording paper at transporting speed V2, and the outer paper ejecting roller 10, and the first and second transporting rollers attempt to rotate at transporting speed V2 following the motion of the paper. Since gear 83 attempts to rotate at a speed faster than the shaft 82, the single-direction rotating clutch of the gear 83 is turned off, and the recording paper is transported at the sorter roller 41 transporting speed of V2.

With the present embodiment, there is no need to increase the ejecting speed of the image forming apparatus itself, so there is no need to provide speed switching means to the driving system of the ejecting unit.

The above-described embodiment involves a sorter as the processing device connected to the ejecting unit of the image forming apparatus. However, the processing device is by no means limited to this, rather, finishers having binding means, folding means, etc. may be used. Or, the processing device may be such which performs other processing.

According to the present invention, an image forming apparatus can be provided wherein sheets can be output at a speed which does not interfere with stacking of the sheets, regardless of the transporting speed of the sheets passing through the fixing means.

What is claimed is:

1. An image forming apparatus, comprising:

toner image forming means for forming a toner image on a sheet;

fixing means for fixing a toner image formed by said toner image forming means on a sheet, while transporting said sheet at a first transporting speed or a second transporting speed which is slower than said first transporting speed;

ejecting means for ejecting from the apparatus the sheet on which fixing has been performed by said fixing means; and holding means for holding said sheet so that a sheet subjected to fixing at said second transporting speed can reach said ejecting means which ejects the sheet at a speed faster than said second transporting speed after passing said fixing means.

2. An image forming apparatus according to claim 1, further comprising a first transporting path for guiding a sheet on which fixing has been performed at the first transporting speed to said ejecting means, and wherein said holding means comprises a second transporting path for guiding the sheet on which fixing has been performed by the second transporting speed to said ejecting means.

3. An image forming apparatus according to claim 2, wherein said second transporting path has a length capable of holding the sheet having a length on which fixing has been performed at the second transporting speed along the length of the sheet.

4. An image forming apparatus according to claim 3, arranged such that the sheet of which the trailing end thereof has passed said fixing means is stopped within said second transporting path before the leading end thereof reaches said ejecting means.

5. An image forming apparatus according to claim arranged such that the amount of time that the sheet is stopped within said second transporting path is changed according to the amount of toner transferred to said sheet.

6. An image forming apparatus according to claim 1, arranged such that the sheet which has passed said fixing means is stopped within said second transporting path before the sheet reaches said ejecting means.

7. An image forming apparatus according to claim 1, wherein said fixing means is capable of transporting a sheet at the first transporting speed when the sheet transported by said fixing means is a recording sheet, and the second transporting speed when the sheet transported by said fixing means is an OHP sheet.

8. An image forming apparatus according to either claim 2 or claim 3, wherein the sheet which has passed through said second transporting path is ejected with a face on which the image has been formed facing downwards.

9. An image forming apparatus according to either claim 2 or claim 3, wherein part of said transporting path serves as part of a both-side transporting path for guiding a sheet onto which an image has been formed on one side to said toner image forming means again, in order to form images on both sides of the sheet.

10. An image forming apparatus according to either claim 2 or claim 3, wherein the sheet which has passed through said second transporting path is ejected with the face on which the image has been formed facing upwards.

11. An image forming apparatus according to either claim 2 or claim 3, wherein part of said second transporting path serves as part of a multiple transporting path for guiding a sheet onto which an image has been formed on one side is guided to said toner image forming means again, in order to layer and form another image on the same side of the sheet.

12. An image forming apparatus according to either claim 2 or claim 3, wherein said ejecting means has a first ejecting opening for ejecting sheets which have passed through said first transporting path and a second ejecting opening for ejecting sheets which have passed through said second transporting path, i.e., separate ejecting openings.

13. An image forming apparatus according to claim 12, wherein said ejecting means further comprises an ejecting roller for rotating by being driven in order to eject sheets, said ejecting roller providing transporting force to both sheets being ejected from said first ejecting opening and sheets being ejected from said second ejecting opening.

14. An image forming apparatus according to any of the claims 2, 6 or 4, wherein said second transporting path bows the sheets in a direction opposite to a face on which the image has been formed.

15. An image forming apparatus, comprising:

toner image forming means for forming a toner image on a sheet;

fixing means for fixing a toner image formed by said toner image forming means on a sheet, while transporting said sheet at a first transporting speed or a second transporting speed which is slower than said first transporting speed; and ejecting means for ejecting from the apparatus the sheet on which fixing has been performed by said fixing means;

said image forming apparatus being arranged such that processing devices which perform processing to the sheets ejected by said ejecting means can be connected thereto;

said image forming apparatus further comprising holding means for holding said sheet between said fixing means and said ejecting means so that sheets subjected to fixing at said second transporting speed can reach said ejecting means after passing said fixing means.

16. An image forming apparatus according to claim 15, further comprising a first transporting path for guiding the sheet on which fixing has been performed at the first transporting speed to said ejecting means, and wherein said holding means comprises a second transporting path for guiding the sheet on which fixing has been performed at the second transporting speed to said ejecting means.

17. An image forming apparatus according to claim 16, wherein said second transporting path has a length capable of holding the sheet on which fixing has been performed at the second transporting speed along the length of the sheet.

18. An image forming apparatus according to claim 17, wherein said ejecting means ejects sheets guided by said second transporting path at a transporting speed faster than said second transporting speed.

19. An image forming apparatus according to claim 17, arranged such that the sheet which has passed said fixing means is stopped within said second transporting path before the sheet reaches said ejecting means.

20. An image forming apparatus according to either claim 16 or claim 17, wherein the sheet which has passed through said second transporting path is ejected with a face on which the image has been formed faxing downwards.

21. An image forming apparatus according to claim 20, arranged such that the amount of time that the sheet is stopped within said second transporting path is changed according to the amount of toner transferred to said sheet.

22. An image forming apparatus according to either claim 16 or claim 17, wherein part of said second transporting path serves as part of a both-side transporting path for guiding a sheet onto which an image has been formed on one side to said toner image forming means again, in order to form images on both sides of the sheet.

23. An image forming apparatus according to either claim 16 or claim 17, wherein the sheet which has passed through said second transporting path is ejected with the face on which the image has been formed facing upwards.

24. An image forming apparatus according to either claim 16 or claim 17, further comprising transporting means for transporting the sheet in said second transporting path, and wherein driving of said transporting means is cut off when said sheets being transported by said transporting means are transported within said processing devices at a third transporting speed.

25. An image forming apparatus according to claim 24, wherein the third transporting speed within said processing devices is faster than the second transporting speed.

26. An image forming apparatus according to claim 25, wherein said transporting means cut off the driving by means of a single-directional rotating clutch.

27. An image forming apparatus according to claim 16, further comprising switch-back means within said second transporting path in order to switch-back the sheets.

28. An image forming apparatus according to either claim 16 or claim 17, wherein part of said second transporting path serves as part of a multiple transporting path for guiding a sheet onto which an image has been formed on one side to said toner image forming means again, in order to layer and form another image on the same side of the sheet.

29. An image forming apparatus according to either claim 16, claim 17, or claim 28, wherein the sheet which has passed through said second transporting path is ejected with the face on which the image has been formed facing upwards.

30. An image forming apparatus according to claim 15, wherein said fixing means is capable of transporting a sheet at the first transporting speed when the sheet transported by said fixing means is a recording sheet, and the second transporting speed when the sheet transported by said fixing means is an OHP sheet.

31. An image forming apparatus according to claim 15, wherein said processing devices comprise sorting means for sorting sheets which have been sent by said ejecting means.

32. An image forming apparatus according to claim 15, wherein said processing device comprises folding means for folding sheets which have been sent by said ejecting means.

33. An image forming apparatus according to claim 15, wherein said processing device comprises binding means for biding sheets which have been sent by said ejecting means.

* * * * *

UNITED STATES PATENT AND TRADEMARK OFFICE

CERTIFICATE OF CORRECTION

PATENT NO. : 6,002,912

DATED : December 14, 1999

INVENTOR(S): AKIO TAKEDA

It is certified that error appears in the above-identified patent and that said Letters Patent is hereby corrected as shown below:

COVER PAGE AT ITEM [57] ABSTRACT,
Line 10, "ejects" should read --eject--.

COLUMN 7,
Line 16, "a" should read --an--.

COLUMN 8,
Line 66, "an" should read --a--.

COLUMN 13,
Line 15, "claim" should read --claim 4,--

COLUMN 14,
Line 40, "faxing" should read --facing--.

Signed and Sealed this

Fourteenth Day of November, 2000

*Attest:*

Q. TODD DICKINSON

*Attesting Officer*

*Director of Patents and Trademarks*